US009798278B2

(12) United States Patent
Nagayama et al.

(10) Patent No.: US 9,798,278 B2
(45) Date of Patent: Oct. 24, 2017

(54) RECORDING MEDIUM HEATING DEVICE, PRETREATMENT LIQUID COATING/DRYING APPARATUS, AND PRINTING SYSTEM

(71) Applicants: Shinji Nagayama, Ibaraki (JP); Takashi Ebihara, Ibaraki (JP); Genichiro Kawamichi, Ibaraki (JP); Yuuji Ohmura, Ibaraki (JP); Kahei Nakamura, Tokyo (JP)

(72) Inventors: Shinji Nagayama, Ibaraki (JP); Takashi Ebihara, Ibaraki (JP); Genichiro Kawamichi, Ibaraki (JP); Yuuji Ohmura, Ibaraki (JP); Kahei Nakamura, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/724,009

(22) Filed: May 28, 2015

(65) Prior Publication Data

US 2015/0346659 A1 Dec. 3, 2015

(30) Foreign Application Priority Data

May 29, 2014 (JP) ..... 2014-111479
Aug. 13, 2014 (JP) ..... 2014-164908

(51) Int. Cl.
*B41J 3/60* (2006.01)
*G03G 15/20* (2006.01)
(Continued)

(52) U.S. Cl.
CPC ..... *G03G 15/2039* (2013.01); *B41J 11/002* (2013.01); *B41J 11/0015* (2013.01); *B41J 3/60* (2013.01); *B41M 5/0011* (2013.01)

(58) Field of Classification Search
USPC ..... 355/27
See application file for complete search history.

(56) References Cited

U.S. PATENT DOCUMENTS 3,015,577 A * 1/1962 Alex ..... D21H 17/52 118/68
5,882,732 A * 3/1999 Barbee ..... G03C 1/74 118/69

(Continued)

FOREIGN PATENT DOCUMENTS

JP H10-202839 8/1998
JP 2003-237035 A 8/2003

(Continued)

OTHER PUBLICATIONS

Patent Translate by EPO and Google (JP2003237035), pp. 1-7.*
Extended European Search Report issued on Aug. 31, 2015 in the corresponding European Application No. 15169710.9.

*Primary Examiner* — Matthew Luu
*Assistant Examiner* — Lily Kemathe
(74) *Attorney, Agent, or Firm* — Oblon, McClelland, Maier & Neustadt, L.L.P.

(57) ABSTRACT

A recording medium heating device that can heat and dry a continuous recording medium, includes multiple heating rollers, including respective heaters, disposed on a conveying path of the recording medium; and a controller to control the heaters of the heating rollers. In a starting period during which the recording medium heating device is started, the controller sets temperatures of the heaters to starting temperatures where a temperature of a heating roller positioned closest to an exit side of the conveying path is lower than a temperature of a heating roller positioned away from the exit side of the conveying path.

13 Claims, 15 Drawing Sheets

(51) Int. Cl.
*B41J 11/00* (2006.01)
*B41M 5/00* (2006.01)

(56) References Cited

U.S. PATENT DOCUMENTS 6,079,330 A 6/2000 Aoki et al.
6,146,028 A * 11/2000 Preszler ..... G03D 13/002 34/639
6,320,642 B1 * 11/2001 Ogawa ..... G03D 13/002 355/27
6,327,444 B1 * 12/2001 Hachisuga ..... G03G 15/2064 219/216
7,157,665 B2 * 1/2007 Ohta ..... G03D 13/002 219/216
7,255,500 B2 * 8/2007 Kido ..... B41J 2/32 219/216
8,203,584 B2 * 6/2012 Struble ..... G03D 13/002 347/171
8,670,012 B2 * 3/2014 Mizutani ..... B41J 2/32 347/179
2002/0105630 A1 * 8/2002 Hashiguchi ..... G03D 13/002 355/405
2002/0135661 A1 * 9/2002 Torisawa ..... G03D 13/002 347/228
2005/0280689 A1 * 12/2005 Preszler ..... B41J 2/315 347/171
2006/0098079 A1 * 5/2006 Kido ..... B41J 2/32 347/171
2007/0089623 A1 * 4/2007 Hamamoto ..... B41F 23/044 101/424.1
2011/0187808 A1 * 8/2011 Struble ..... G03D 13/002 347/223
2014/0132658 A1 5/2014 Suzuki et al.
2014/0232797 A1 8/2014 Onodera et al.

FOREIGN PATENT DOCUMENTS

JP 2012-035566 2/2012
JP 2012-91320 A 5/2012
JP 2014-184711 10/2014

* cited by examiner

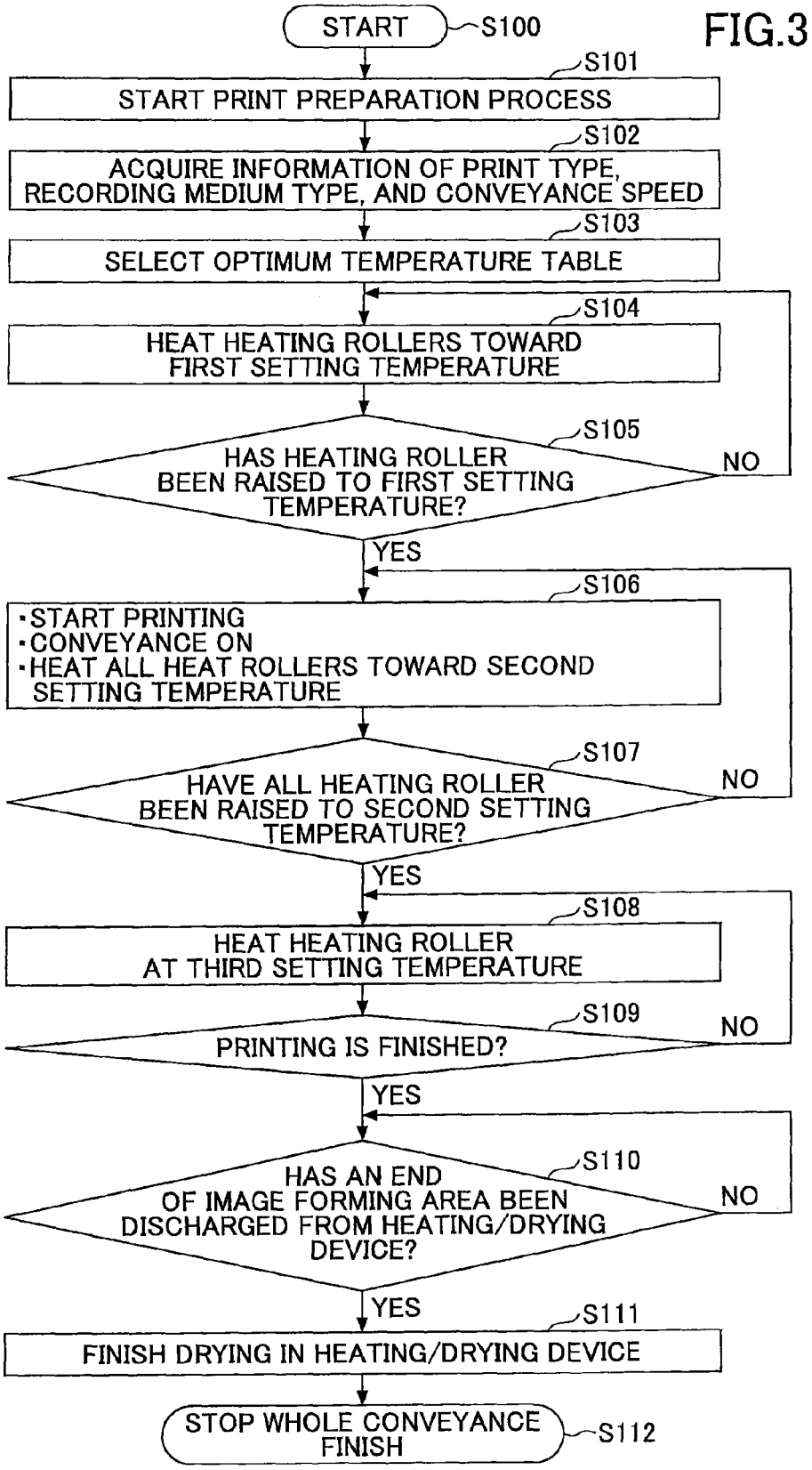
FIG.3
START
S100
S101
START PRINT PREPARATION PROCESS
S102
ACQUIRE INFORMATION OF PRINT TYPE, RECORDING MEDIUM TYPE, AND CONVEYANCE SPEED
S103
SELECT OPTIMUM TEMPERATURE TABLE
S104
HEAT HEATING ROLLERS TOWARD FIRST SETTING TEMPERATURE
S105
HAS HEATING ROLLER BEEN RAISED TO FIRST SETTING TEMPERATURE?
NO
YES
S106
・START PRINTING
・CONVEYANCE ON
・HEAT ALL HEAT ROLLERS TOWARD SECOND SETTING TEMPERATURE
S107
HAVE ALL HEATING ROLLER BEEN RAISED TO SECOND SETTING TEMPERATURE?
NO
YES
S108
HEAT HEATING ROLLER AT THIRD SETTING TEMPERATURE
S109
PRINTING IS FINISHED?
NO
YES
S110
HAS AN END OF IMAGE FORMING AREA BEEN DISCHARGED FROM HEATING/DRYING DEVICE?
NO
YES
S111
FINISH DRYING IN HEATING/DRYING DEVICE
STOP WHOLE CONVEYANCE FINISH
S112

COMPARATIVE EXAMPLE

PRESENT EMBODIMENT

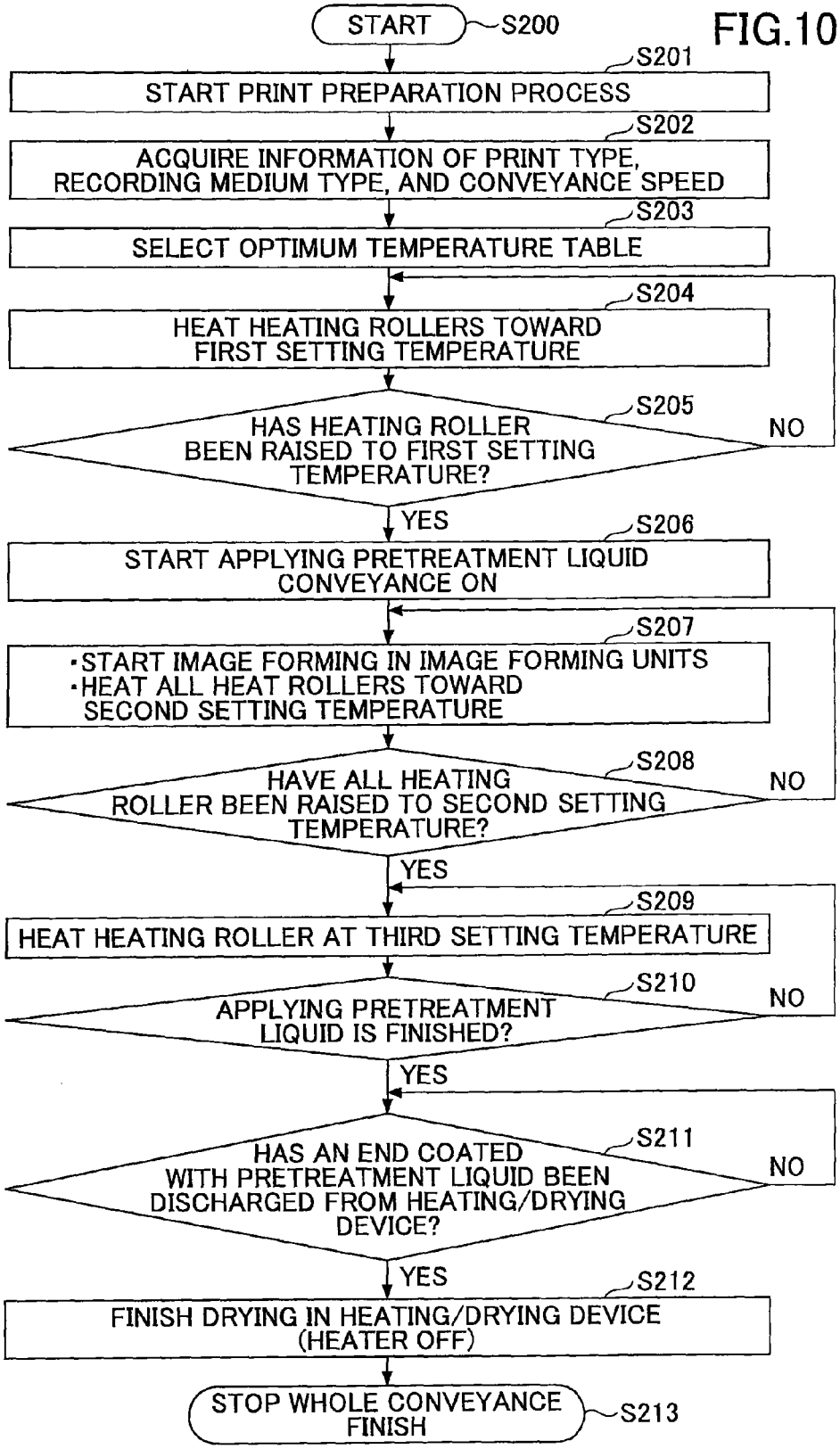
FIG.10
START
S200
S201
START PRINT PREPARATION PROCESS
S202
ACQUIRE INFORMATION OF PRINT TYPE, RECORDING MEDIUM TYPE, AND CONVEYANCE SPEED
S203
SELECT OPTIMUM TEMPERATURE TABLE
S204
HEAT HEATING ROLLERS TOWARD FIRST SETTING TEMPERATURE
S205
HAS HEATING ROLLER BEEN RAISED TO FIRST SETTING TEMPERATURE?
NO
YES
S206
START APPLYING PRETREATMENT LIQUID CONVEYANCE ON
S207
·START IMAGE FORMING IN IMAGE FORMING UNITS
·HEAT ALL HEAT ROLLERS TOWARD SECOND SETTING TEMPERATURE
S208
HAVE ALL HEATING ROLLER BEEN RAISED TO SECOND SETTING TEMPERATURE?
NO
YES
S209
HEAT HEATING ROLLER AT THIRD SETTING TEMPERATURE
S210
APPLYING PRETREATMENT LIQUID IS FINISHED?
NO
YES
S211
HAS AN END COATED WITH PRETREATMENT LIQUID BEEN DISCHARGED FROM HEATING/DRYING DEVICE?
NO
YES
S212
FINISH DRYING IN HEATING/DRYING DEVICE (HEATER OFF)
STOP WHOLE CONVEYANCE FINISH
S213

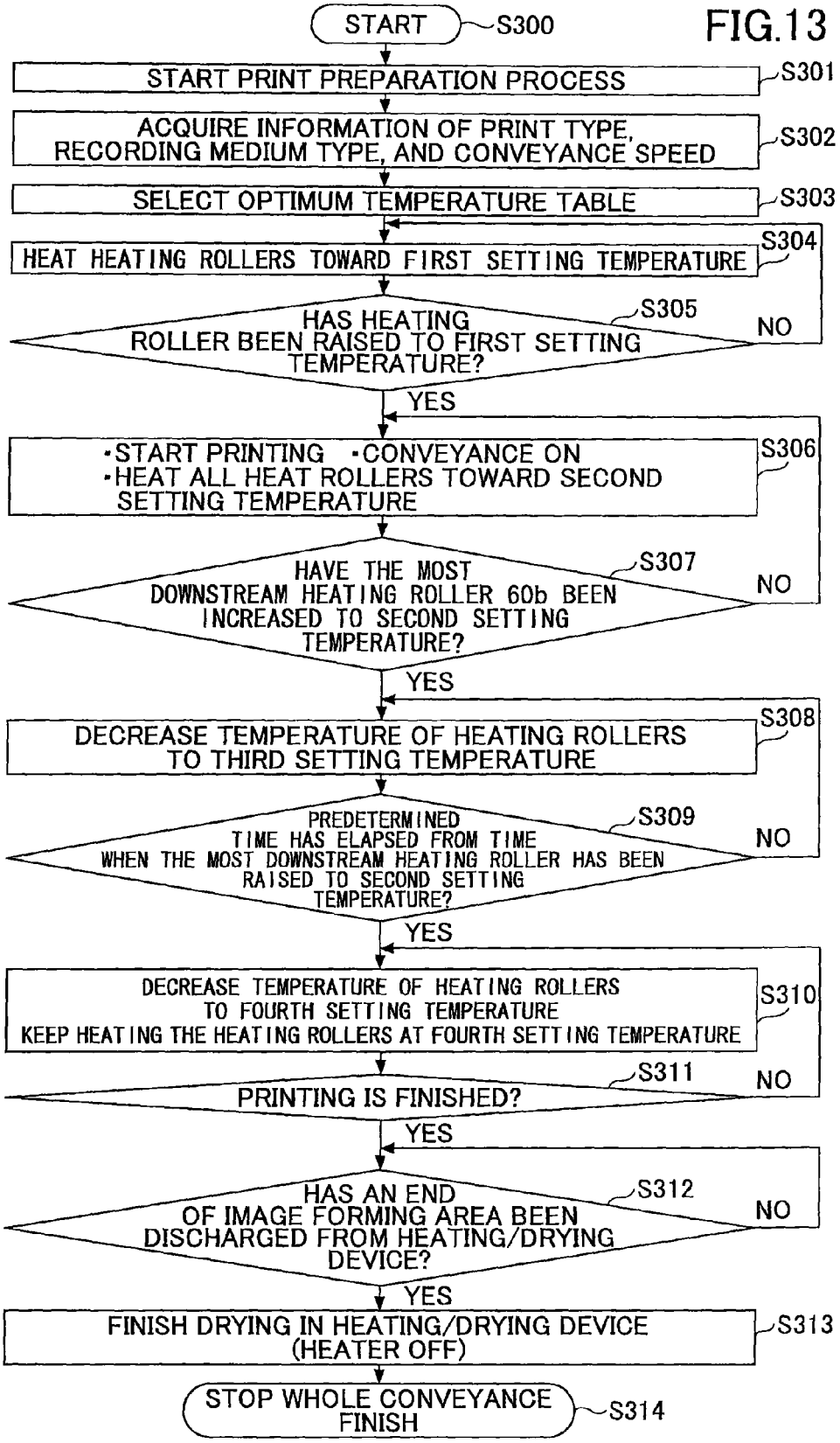
FIG.13
START
S300
START PRINT PREPARATION PROCESS
S301
ACQUIRE INFORMATION OF PRINT TYPE, RECORDING MEDIUM TYPE, AND CONVEYANCE SPEED
S302
SELECT OPTIMUM TEMPERATURE TABLE
S303
HEAT HEATING ROLLERS TOWARD FIRST SETTING TEMPERATURE
S304
HAS HEATING ROLLER BEEN RAISED TO FIRST SETTING TEMPERATURE?
S305
NO
YES
·START PRINTING ·CONVEYANCE ON
·HEAT ALL HEAT ROLLERS TOWARD SECOND SETTING TEMPERATURE
S306
HAVE THE MOST DOWNSTREAM HEATING ROLLER 60b BEEN INCREASED TO SECOND SETTING TEMPERATURE?
S307
NO
YES
DECREASE TEMPERATURE OF HEATING ROLLERS TO THIRD SETTING TEMPERATURE
S308
PREDETERMINED TIME HAS ELAPSED FROM TIME WHEN THE MOST DOWNSTREAM HEATING ROLLER HAS BEEN RAISED TO SECOND SETTING TEMPERATURE?
S309
NO
YES
DECREASE TEMPERATURE OF HEATING ROLLERS TO FOURTH SETTING TEMPERATURE
KEEP HEATING THE HEATING ROLLERS AT FOURTH SETTING TEMPERATURE
S310
PRINTING IS FINISHED?
S311
NO
YES
HAS AN END OF IMAGE FORMING AREA BEEN DISCHARGED FROM HEATING/DRYING DEVICE?
S312
NO
YES
FINISH DRYING IN HEATING/DRYING DEVICE (HEATER OFF)
S313
STOP WHOLE CONVEYANCE FINISH
S314

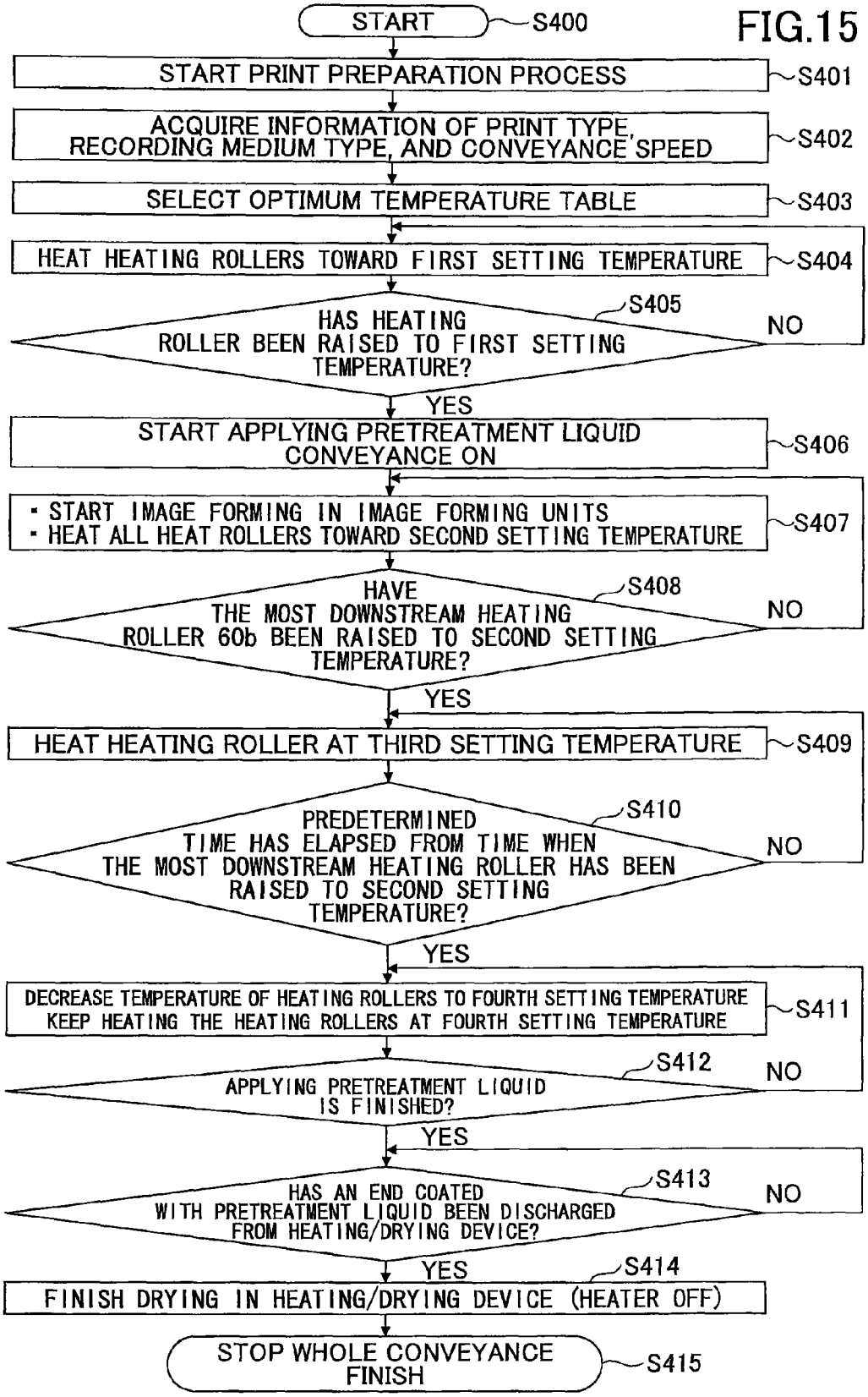
FIG.15
START
S400
START PRINT PREPARATION PROCESS
S401
ACQUIRE INFORMATION OF PRINT TYPE, RECORDING MEDIUM TYPE, AND CONVEYANCE SPEED
S402
SELECT OPTIMUM TEMPERATURE TABLE
S403
HEAT HEATING ROLLERS TOWARD FIRST SETTING TEMPERATURE
S404
HAS HEATING ROLLER BEEN RAISED TO FIRST SETTING TEMPERATURE?
S405
NO
YES
START APPLYING PRETREATMENT LIQUID CONVEYANCE ON
S406
• START IMAGE FORMING IN IMAGE FORMING UNITS
• HEAT ALL HEAT ROLLERS TOWARD SECOND SETTING TEMPERATURE
S407
HAVE THE MOST DOWNSTREAM HEATING ROLLER 60b BEEN RAISED TO SECOND SETTING TEMPERATURE?
S408
NO
YES
HEAT HEATING ROLLER AT THIRD SETTING TEMPERATURE
S409
PREDETERMINED TIME HAS ELAPSED FROM TIME WHEN THE MOST DOWNSTREAM HEATING ROLLER HAS BEEN RAISED TO SECOND SETTING TEMPERATURE?
S410
NO
YES
DECREASE TEMPERATURE OF HEATING ROLLERS TO FOURTH SETTING TEMPERATURE
KEEP HEATING THE HEATING ROLLERS AT FOURTH SETTING TEMPERATURE
S411
APPLYING PRETREATMENT LIQUID IS FINISHED?
S412
NO
YES
HAS AN END COATED WITH PRETREATMENT LIQUID BEEN DISCHARGED FROM HEATING/DRYING DEVICE?
S413
NO
YES
FINISH DRYING IN HEATING/DRYING DEVICE (HEATER OFF)
S414
STOP WHOLE CONVEYANCE FINISH
S415

RECORDING MEDIUM HEATING DEVICE, PRETREATMENT LIQUID COATING/DRYING APPARATUS, AND PRINTING SYSTEM

BACKGROUND

1. Field

The present invention relates to a recording medium heating device, a pretreatment liquid coating/drying apparatus, and a printing system.

2. Description of the Related Art

In printing systems, such as rotary presses, in order to evaporate the solvent of ink printed on a sheet, there is a technique in which a sheet is dried by multiple heating rollers provided on the conveying path of the sheet; see, for example, JP-H10-202839-A.

In addition, image recording of an inkjet method is becoming increasingly popular these days because of its advantage that colorization can be easily realized, in addition to its advantages of low noise and low running cost. However, when an image is formed on a recording medium which is not manufacturer-specified paper, problems related to initial image quality such as image blur, image concentration change, color tone change, image show-through, etc., occur. In addition, problems related to robustness of images such as water resistance, weather resistance, etc., occur.

In order to solve this problem, a treatment liquid that has a function to agglomerate the ink is applied immediately before the ink droplets are ejected to the sheet (recording medium), thereby improving the image quality. In a case where the pretreatment liquid is applied, it is necessary to dry the sheet before the ink is ejected. Herein, in a drying device that dries the sheet with multiple heating rollers provided on the conveying path of the sheet, there is a risk of cockling occurring, that is a wave-shaped deformation of the sheet upstream of and/or downstream of the drying device.

Accordingly, for example, in JP-2012-035566-A, in order to prevent the occurrence of cockling, after the ink lands on the recording medium in the printing operation, a drying device having a seasoning unit sprays heated moist air on the recording medium.

A possible drawback of the drying device with the seasoning unit described above is that, because multiple processes are required, the configuration of the device is complicated and large scale. In addition, although since the above-described device disposes a countermeasure for the cockling during printing, the cockling is not taken into account in starting in the above-described drying device.

SUMMARY

In view of the above circumstances, in one aspect, the present invention proposes a heating device to suppress the occurrence of the cockling in starting.

In an embodiment which solves or reduces one or more of the above-mentioned problems, the present invention provides a recording medium heating device to heat and dry a continuous recording medium, that includes multiple heating rollers, including respective heaters, disposed on a conveying path of the recording medium; and a controller to control the heaters of the heating rollers. In a starting period during which the recording medium heating device is started, the controller sets temperatures of the heaters to starting temperatures where a temperature of a heating roller positioned closest to an exit side of the conveying path is lower than a temperature of a heating roller positioned away from the exit side of the conveying path.

Another illustrative embodiment of the present invention provides a pretreatment liquid coating/drying apparatus that includes a coating device to apply a pretreatment liquid onto a continuous recording medium; and the above-described recording medium heating device.

Yet another illustrative embodiment of the present invention provides a printing system that includes the above-described pretreatment liquid coating/drying apparatus and a printing apparatus to eject ink onto the recording medium on which the pretreatment liquid is applied and dried by the pretreatment liquid coating/drying apparatus.

BRIEF DESCRIPTION OF THE DRAWINGS

Other objects and further features of embodiments will become apparent from the following detailed description when read in conjunction with the accompanying drawings, in which:

FIG. 3 is a flowchart illustrating a control method shown in FIG. 1, according to a first embodiment;

FIG. 10 is a control flowchart of the printing system shown in FIG. 7;

FIG. 13 is a control flowchart of the printing system shown in FIG. 6;

FIG. 15 is a control flowchart of the printing system shown in FIG. 11.

DESCRIPTION OF THE PREFERRED EMBODIMENTS

Figure 1:
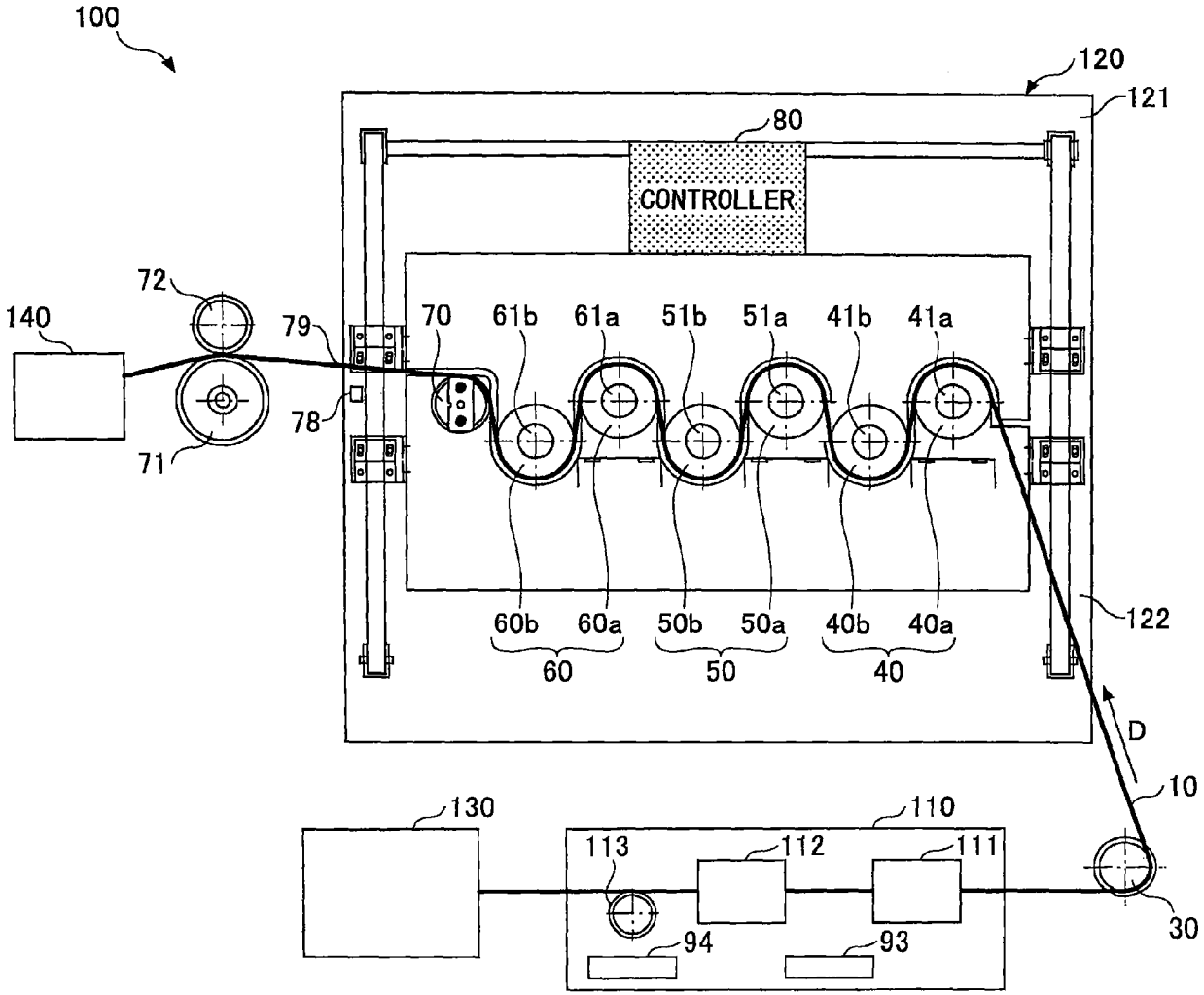
FIG. 1 is a schematic diagram illustrating a system including a recording medium heating device according to embodiments of the present invention.

In the following, embodiments of the present invention will be described with reference to the accompanying drawings. It should be noted that configuration elements which include substantially the same functional configurations in the present specification and the drawings are assigned the same reference numerals and duplicated description is omitted.

Entire Configuration

First Embodiment

FIG. 1 is a system (printing apparatus) 100 that employs a heating/drying device (recording medium heating device) 120. In the system 100 according to the first embodiment shown in FIG. 1, an image forming apparatus (recording apparatus, printer) 110 and a sheet feeding apparatus 130 are disposed upstream from the heating/drying device 120, and a sheet after-processing apparatus 140 is disposed downstream from the heating/drying device (ink drying apparatus) 120.

Herein, as the sheet after-processing apparatus 140, a sheet winding apparatus to wind up the recording medium 10 after printing or a folding apparatus to fold the recording medium 10 is provided. It is to be noted that, although the heating/drying device 120 is depicted with emphasis in FIG. 1, the actual dimension relative to the other apparatuses is different.

The image forming apparatus 110 is a printing apparatus that ejects ink onto the recording medium 10 to form images thereon, for example, a rotary press (printing machine), an inkjet printer, or a facsimile machine. The image forming apparatus 110 includes a front-side image forming unit 111 and a back-side image forming unit 112. Head units of the image forming units 111 and 112 eject liquid such as ink onto the recording medium 10, which forms the image on the recording medium 10.

The recording medium 10, output from a conveyance roller (conveyance member) 113 of the image forming apparatus 110, is conveyed to the heating/drying device 120 via a sheet supply roller (conveyance roller) 30, in a conveyance direction in which the recording medium 10 is conveyed as indicated by an arrow D shown in FIG. 1. The recording medium 10 may be a given continuous sheet, alternatively; may be a relatively elongated piece of paper. The recording medium 10 may be a formed of a material, such as paper and plastic sheet, where there is a risk of suffering damage, such as wrinkling and deformation thereof by heating.

In addition, the sheet supply roller 30 is disposed on the upstream side of the heating/drying device 120. A feed roller 71 that receives a driving rotational force from a driving force source such as motor, and a feed-nip roller 72 driven by the feed roller 71 are provided on the downstream side of the heating/drying device 120.

The heating/drying device 120 includes a first-step heating roller set 40, a second-step heating roller set 50, a third-step heating roller set 60, a sheet delivery roller 70, and a controller 80. The first-step heating roller set 40 includes heating rollers 40*a* and 40*b*, the second-step heating roller set 50 includes heating rollers 50*a* and 50*b*, and the third-step heating roller set 60 includes heating rollers 60*a* and 60*b*.

In FIG. 1, an upper portion of the heating/drying device 120 functions as a front-side heating unit 121, including the first-step front-side heating roller 40*b*, the second-step front-side heating roller 50*b*, and the third-step front-side heating roller 60*b*. Moreover, a lower portion of the heating/drying device 120 functions as a back-side heating unit 122, including the first-step back-side heating roller 40*a*, the second-step back-side heating roller 50*a*, the third-step back-side heating roller 60*a*, and the sheet delivery roller 70. Reference numeral 79 indicates an exit of the heating/drying device 120, and an exit sensor 78 is provided close to the exit 79. It is to be noted that the controller 80 including heating controllers 81 through 86, and the exit sensor 78 are provided in either heating unit 121 or 122.

The first-step heating roller set 40, the second-step heating roller set 50, and the third-step heating roller set 60 are disposed within a conveying path of the recording medium 10 in this order from upstream to downstream in the conveyance direction D.

Ends of the heating rollers 40*a*, 40*b*, 50*a*, 50*b*, 60*a*, and 60*b* (hereinafter referred as "40*a* through 60*b*") in an axial direction thereof are rotatably supported by corresponding bearings.

The first-step back-side heating roller 40*a* and the first-step front-side heating roller 40*b*, the second-step back-side heating roller 50*a* and the second-step front-side heating roller 50*b*, and the third-step back-side heating roller 60*a* and the third-step front-side heating roller 60*b* are separately positioned relative to each other. The heating rollers 40*a* through 60*b* are arranged in two rows and in a zigzag state. For example, an assumed line connecting respective rotational axes of the first-step back-side heating roller 40*a*, the second-step back-side heating roller 50*a*, and the third-step back-side heating roller 60*a* are positioned parallel to and separated from an assumed line connecting respective rotational axes of the first-step front-side heating roller 40*b*, the second-step front-side heating roller 50*b*, and the third-step front-side heating roller 60*b*.

Heaters 41*a*, 41*b*, 51*a*, 51*b*, 61*a*, and 61*b* (hereinafter referred as "41*a* through 61*b*"), functioning as heat generators that have heat capacities to supply required heating amount for drying, are provided with the respective heating rollers 40*a* through 60*b*. With this configuration, the heaters 41*a* through 61*b* can heat the surfaces of the heating rollers 40*a* through 60*b*. For example, the heaters 41*a* through 61*b* are disposed on center positions of the heating rollers 40*a* through 60*b*.

Further, heat pipes (not shown) may be further provided inside of the heating rollers 40*a* through 60*b*, respectively. The heat pipes function as heat generating regions, covering conveyance regions on which the recording medium 10 is conveyed. Each heat pipe transfers the heat of the heating roller in an axial direction efficiently, makes the temperature of the surface of the roller uniform, and efficiently supplies (transfer) heat to the recording medium 10.

Further, temperature sensor 42*a* through 62*b* (see FIG. 2) such as thermistors or/and thermopiles to detect the surface temperatures of the respective heating rollers 40*a* through 60*b*, are provided in the heating rollers 40*a* through 60*b*.

The respective heating rollers 40*a* through 60*b* are made of metal, such as aluminum. Alternately, in order to prevent the adhesion of the ink, the surface thereof may be coated with a fluoro material, and a non-adhesion film.

The heating rollers 40*a* through 60*b* are arranged in two rows and in the zigzag state. The recording medium 10 is wound around the respective heating rollers 40*a*, 40*b*, 50*a*, 50*b*, 60*a*, and 60*b* in this order from upstream side to the downstream side in the conveyance direction D. The recording medium 10 is conveyed on the respective heating rollers 40*a* through 60*b* in zigzag shape.

Accordingly, the back-side face of the recording medium 10, positioned downward as shown in FIG. 1 contacts the first-step back-side heating roller 40*a*, the second-step backside heating roller 50*a*, and the third-step back-side heating roller 60*a*. Further, the front-side face of the recording medium 10, positioned upward as shown in FIG. 1 contacts the first-step front-side heating roller 40*b*, the second-step front-side heating roller 50*b*, and the third-step front-side heating roller 60*b*.

Figure 2:
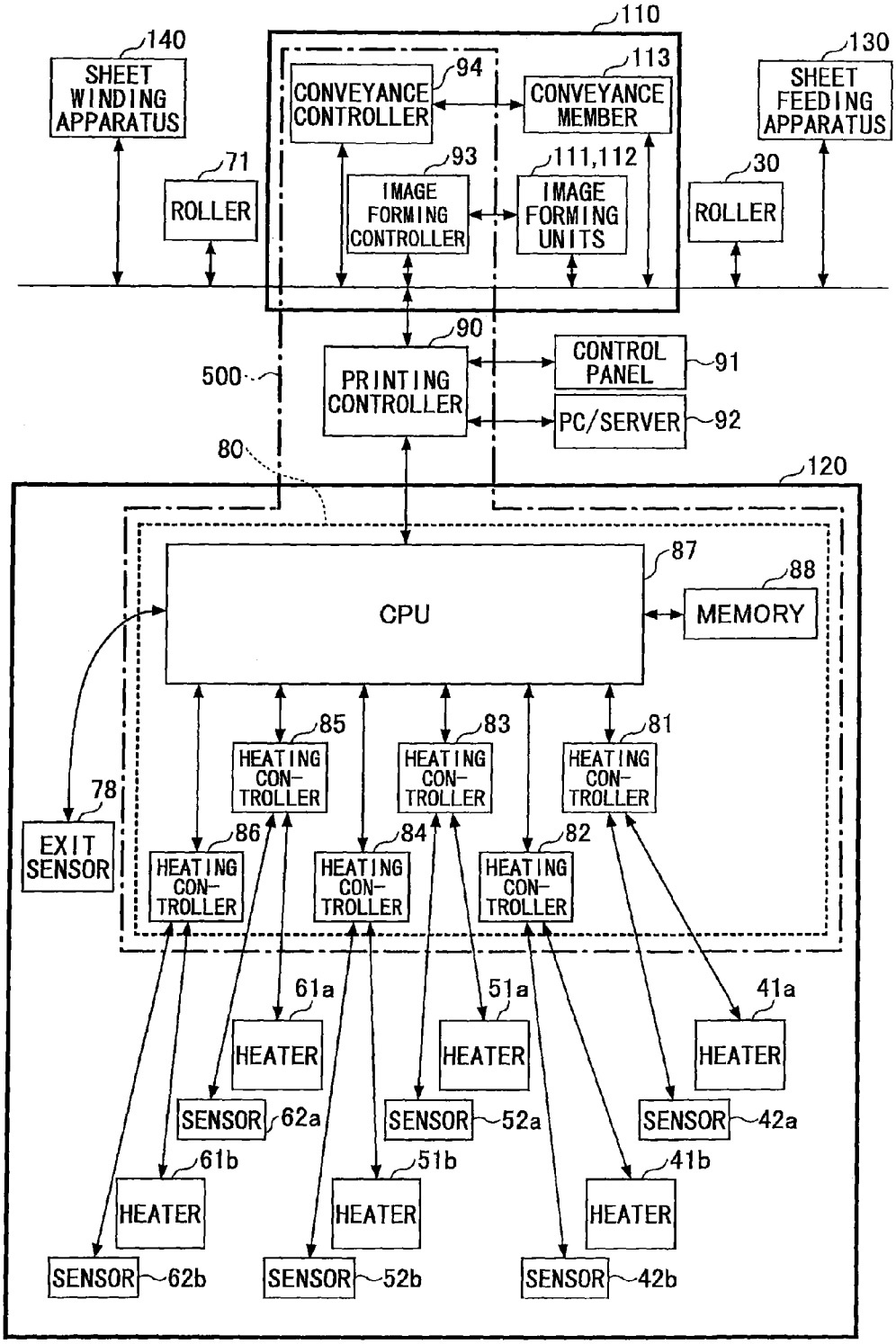
FIG. 2 is a control block diagram illustrating an entire system of the heating device shown in FIG. 1.

FIG. 2 shows a control block diagram illustrating an entire system including the heating/drying device 120. As illustrated in FIG. 2, the controller 80 of the heating/drying device 120 is installed in a control system 500 of the system (printing apparatus) 100.

The controller 80 of the heating/drying device 120 includes heating controllers 81 through 86, corresponding to the heating rollers 40*a* through 60*b*, a CPU 87, and a memory 88. Herein, although not shown, the controller 80 further includes a RAM and a ROM storing a program to execute heating, an I/O (input/output terminal), and an I/F (interface) to receive the data from the printing controller 90.

The heating controllers 81 through 86, which are connected to the heaters 41*a* through 61*b* configured with halogen lamps, provided inside the heating rollers 40*a* through 60*b*, each include heater driving circuits, etc., to adjust an applying voltage to the heaters 41*a* through 61*b*. While the applied voltage generated in each of the heater driving circuits is adjusted, a voltage value itself to be applied may be changed; alternatively, a predetermined voltage is applied periodically, and the voltage applying duty ratio within the duty cycle may be changed.

In addition, the heating controllers 81 through 86, which are connected to the temperature sensors 42*a* through 62*b*, control the heaters 41*a* through 61*b* such that the surface temperatures of the heating rollers 40*a* through 60*b* are adjusted within a predetermined temperature range.

The memory 88 stores multiple temperature tables as combinations of first setting temperatures (temperature in starting), a second setting temperature (upper limit temperature), and third setting temperatures (homogeneously imparting amounts of heat for respective heaters (homogeneous increase in temperature)), based on types of recording medium and/or conveyance speed.

The control system 500 of the system 100 includes the printing controller 90, an image forming controller 93, and a conveyance controller 94, so as to control the components of the image forming apparatus 110.

Further, the printing controller 90, which is connected to a control panel 91, a personal computer (PC) or/and server 92, the sheet feeding apparatus 130, and the after-processing apparatus (sheet winding apparatus) 140 via multiple data lines and control lines, totally controls the image forming operation containing ink drying. The printing controller 90 executes a RIPS (Raster Image processing) process, in accordance with the printing job data supplied from, for example, a host apparatus, and generates bit map data for respective colors. In addition, the printing controller 90 generates control information to control the printing operation, based on the printing job information and the information relating to the host apparatus. Herein, the printing controller 90 may be provided inside the image forming apparatus 110.

In the image forming apparatus 110, the image forming controller 93 connected to the printing controller 90 controls the front-side image forming unit 111 and the back-side image forming unit 112. Further, the conveyance controller 94, which is connected to the conveyance roller (member) 113 in the image forming apparatus 110 and is connected to the conveyance rollers 30 and 71 disposed in vicinity of the heating/drying device 120, controls the conveyance of the recording medium 10.

In the controller 80 of the heating/drying device 120, the CPU 87 controls the heating controllers 81 through 86 based on the information acquired from the connected printing controller 90.

In the present embodiment, the controller 80 monitors the temperatures of the heating rollers 40*a* through 60*b* detected by the temperature sensors 42*a* through 62*b*, and controls the respective heaters 41*a* through 61*b* provided in the heating rollers 40*a* through 60*b* as follows. In this process, the controller 80 controls the respective heaters 41*a* through 61*b* provided in the heating rollers 40*a* through 60*b* such that the surface of the recording medium 10 on which the ink is ejected (front side, back side or both sides) is dried.

When the ink is ejected to only the front side of the recording medium 10, the front-side heating controllers 82, 84, and 86 of the controller 80 control the heaters 41*b*, 51*b*, and 61*b*, such that the heating rollers 40*b*, 50*b*, and 60*b* are adjusted to be at the setting temperatures. Thus, the heating rollers 40*b*, 50*b*, and 60*b* heat only the front side of the recording medium 10 to dry the ink thereon.

By contrast, when the ink is ejected to only the back side of the recording medium 10, the back-side heating controllers 81, 83, and 85 of the controller 80 control the heaters 41*a*, 51*a*, and 61*a*, such that the heating rollers 40*a*, 50*a*, and 60*a* are adjusted to be at the setting temperatures. Thus, the heating rollers 40*a*, 50*a*, and 60*a* heat only the back side of the recording medium 10 to dry the ink thereon.

Alternatively, when the ink is ejected to both sides of the recording medium 10, the heating controllers 81 through 86 of the controller 80 control the heaters 41*a* through 61*b*, such that the respective heating rollers 40*a* through 60*b* are adjusted to be at the setting temperatures. Thus, the heating rollers 40*a* through 60*b* heat both sides of the recording medium 10 to dry the ink thereon.

The recording medium 10 is conveyed from the image forming apparatus 110 provided upstream from the heating/drying device 120 in a state in which the ink is ejected to at least one side of the recording medium 10. The recording medium 10 conveyed into the heating/drying device 120, initially contacts an outer circumferential surface of the first-step heating roller 40*a*. The contact face of the recording medium 10 is heated to an appropriate temperature by the heating roller 40*a* or 40*b*, to evaporate moisture and solvent in the ink landing on the recording medium 10. This evaporation is executed for the first step, the second step, and the third step of the heating rollers 40*a* through 60*b*, which can dry the ink landing on the recording medium 10.

In this way, in a case where the ink lands on either the front side or the back side of the recording medium 10, the only ink landing side of the recording medium 10 is dried. Herein, in a case where only one side of the recording medium 10 is dried, or in a case where the operation of the heating/drying device 120 is stopped, the controller 80 may shut off the respective heaters 41*a* through 61*b*. Alternatively, in the case where either front side or back side is dried, the controller 80 may operate the heaters that is not being heated such that the temperatures of the heating rollers for the face opposite to the face on which the ink lands, is set at a waiting temperature that is lower than the setting temperature of the heating rollers.

For example, the temperatures of the heating rollers 40*a* through 60*b* for the heating side, that is the side on which the ink lands, are 60° C. to 120° C., and the standby temperatures are, for example from 40° C. to 45° C. Herein, when the temperature exceeds 45° C., the recording medium 10 may thermally deform, and when the temperature is equal to or lower than 40° C., it is not effective for retaining warmth. Therefore, the temperature range from 40° C. to 45° C. is the suitable standby temperature range.

The controller 80 controls the temperatures of the respective heating rollers 40*a* through 60*b* based on the actual temperatures of the heating rollers 40*a* through 60*b* detected by the temperature sensors 42*a* through 62*b*, and based on the operation state, such as at the rotational velocities of the sheet delivery roller 70 and/or the sheet supply roller 30.

Herein, when the ink lands on one of the front side or the back side of the recording medium 10, the controller 80 controls the respective heaters 41*a* through 61*b*, such that water contents of the recording medium 10 discharged from the heating/drying device 120 are set equal to the water contents of the recording medium 10 fed by the sheet feeding apparatus 130. That is, the controller 80 controls the respective heaters 41*a* through 61*b* such that the total amount W of heat supplied to the recording medium 10 from the heating rollers 40*a* through 60*b* for use (total amount of heat corresponding to the increased amount of setting temperature in the respective steps) exceeds the sufficient amount to evaporate the moisture and the solvent contained in the ink landing on the recording medium 10.

Herein, assuming that all the heating rollers 40*a* through 60*b* are set to the temperatures that are equivalent to the maximum temperature of the setting temperature whose amounts of heat for imparting all the heating rollers are equal, when the recording medium 10 enters the heating/drying device 120 during printing, the temperature of the recording medium 10 may be rapidly raised. Thus, due to the heat load exerted by the heating roller 40*a* positioned on the entrance side, there is a risk of suffering damage such as wrinkling and deformation of the recording medium 10 by heating.

In order to solve this problem, during continuous drying, the temperature of the heating roller positioned on the entrance side is set lower and that on the exit side is set higher, thereby setting temperatures having a temperature gradient, such that the amounts of heat imparted by the multiple heating rollers for the recording medium 10 are equivalent (homogeneously imparting the amounts of heat caused by temperature increase based on duty ratios in the heaters). By setting the continuous drying temperatures having the temperature gradient, the heat amount required for drying can be applied to the recording medium 10 efficiently. The temperatures of the heating rollers are controlled so as to gradually increase the temperature (heating amount) applying to the recording medium 10 from upstream side to downstream side and perform efficient drying. Further, by setting the continuous drying temperatures having the temperature gradient, any damage to the recording medium 10 is made uniform and the heat loss of the respective rollers 40*a* through 60*b* are made uniform so that the risk occurring the excess temperature increase is dispersed, which can normalize (make uniform) the device service lives of the respective heaters 41*a* through 61*b*.

As described above, considering the damage from the heating roller 40*a* that initially contact during continuous drying, the example of the setting temperatures having temperature gradient is shown in TABLE 1.

TABLE 1

| PRINTING CONDITION | | | REQUIRED AMOUNT OF HEAT FOR HEATING ROLLERS | | |
|---|---|---|---|---|---|
| PRINTING SPEED | TYPES OF RECORDING MEDIUM | AMOUNT OF APPLYING LIQUD | FIRST-STEP HEATING ROLLER SET 40 | SECOND-STEP HEATING ROLLER SET 50 | THIRD-STEP HEATING ROLLER SET 60 |
| *3 50 mpm | COATED PAPER A | A pattern | 50 | 65 | 80 |
| *1 30 mpm | COATED PAPER A | B pattern | 40 | 50 | 60 |
| 50 mpm | COATED PAPER B | A pattern | 60 | 75 | 90 |
| *2 30 mpm | COATED PAPER B | B pattern | 50 | 60 | 70 |
| 50 mpm | COATED PAPER C | A pattern | 90 | 105 | 120 |
| *4 30 mpm | COATED PAPER C | B pattern | 80 | 90 | 100 |

As illustrated in TABLE 1, the amounts of heat required for supplying the recording medium 10 from the respective heating rollers 40*a* through 60*b* differ depending on types (thickness, width) of recording medium 10. Further, the required heat amount changes depending on the time during which the recording medium 10 contacts the respective heating rollers 40*a* through 60*b* (conveyance speed of the recording medium 10), at rotational velocities of the sheet discharge roller 70 and/or the sheet supply roller 30.

Using settings based on the TABLE 1, the recording medium 10 initially will contact the first-step heating roller set 40 whose setting temperature is lowest in the heating roller sets 40, 50, and 60, which can reduce the temperature difference between the recording medium 10 and the heating roller 40*a* that initially contacts the recording medium 10. Accordingly, compared with the case where all the heating rollers 40*a* through 60*b* are set to the highest setting temperature, the rapid temperature increase in the recording medium 10 can be avoided. Therefore, the system including the heating/drying device 120 can minimize the heat load exerted on the recording medium 10. Thus, suffering the damage such as wrinkling and deforming of the recording medium 10 due to the heat load can be suppressed.

As described above, in order to make the heat supplying amount for the respective steps uniform during continuous printing (drying), it is preferable that the temperatures of the multiple heating rollers be set to have a predetermined temperature gradient. Herein, in order to make the amounts of heat imparted during the respective steps equal while ensuring the heat amount required for drying the sheet, it is necessary to raise the temperature of the heating rollers 60*a* and 60*b* provided on the downstream side (third step).

However, in a case where the temperatures are set to have the temperature gradient, even though the condition of the coated paper A, pattern B, 30 mpm of the conveyance speed, that is the lowest temperature for use shown in *1 in TABLE 1 are used, in starting printing, that is, in a starting period during which the heating/drying device 120 is starting, the temperatures of the heating rollers 60*a* and 60*b* are raised to 60° C. If the temperatures the third-step heating rollers 60*a*, 60*b* positioned on the downstream side (exit side) have been raised to the highest setting temperature in the starting period during which the heating/drying device 120 is starting, it is a risk that the area of the recording medium 10 contacting the third-step heating rollers 60*a*, 60*b* on the exit side may thermally shrink due to the evaporation of the moisture in the ink in a width direction of the recording medium 10. By contrast, on the outer side (at normal temperature) on the heating/drying device 120, due to the thermal shrinkage of the recording medium 10 caused by the heating rollers, the recording medium 10 rapidly absorbs moisture of the ink immediately after the exit of the heating/drying device 120 due to the temperature and the humidity difference between inside and outside of the heating/drying device 120.

Accordingly, the width of the recording medium positioned outside is different from the width of the recording medium positioned inside, which generates the shrinkage difference between the area positioned outside of the heating/drying device 120 and the area contacting the heating roller 60*a* or 60*b* positioned inside on the exit side, caused by a temperature difference and a humidity difference. Thus, cockling (waveform deformation) may occur, in the recording medium 10.

It is to be noted that, although the recording medium 10 may thermally shrink caused by the contact of the heating roller 40*a* provided on the upstream side, considering that the setting temperature for the upstream side is lower than that for the downstream side, a lesser degree of the cockling may occur on the upstream side by continuously passing the recording medium 10 through the drying process containing the heating rollers.

In order to solve this problem, in the present invention, in order to alleviate the damage to the recording medium 10 caused by the first-step heating rollers 40*a* and 40*b* that initially come in contact with the recording medium 10 during continuous printing, and in order alleviate the shrinkage of the recording medium 10 caused by the third-step heating roller 60*a* and 60*b* provided on the exit side in the starting period of printing, setting temperatures are changed for each time period.

More specifically, in the starting period during which the heating/drying device 120 is starting, the temperatures of the heating rollers 60*a* and 60*b* positioned on the exit side of the conveying path are set lower than the temperatures of the heating rollers 40*a*, 40*b*, 50*a*, and 50*b* positioned far from the exit side. Specifically, in the starting period during which the heating/drying device 120 is starting, in order to apply the necessary minimum value, first setting temperatures are set such that the temperatures of the heating rollers 40*a*, 60*a* and 60*b* positioned on the entrance side and positioned on the exit side are lower than the temperatures of the heating rollers 40*b*, 50*a*, and 50*b* positioned on the center area.

Then, in order not to decrease below the needed heat amount, temperatures of all the heating rollers 40*a* through 60*b* are increased toward the upper limit temperatures (second setting temperatures). In addition, during continuous printing, the temperatures of the multiple heating rollers 40*a* through 60*b* are shifted to the third setting temperatures having the temperature gradient in which the amounts of heat imparted to the respective heaters 41*a* through 61*b* are set to be equal.

Figure 5A:
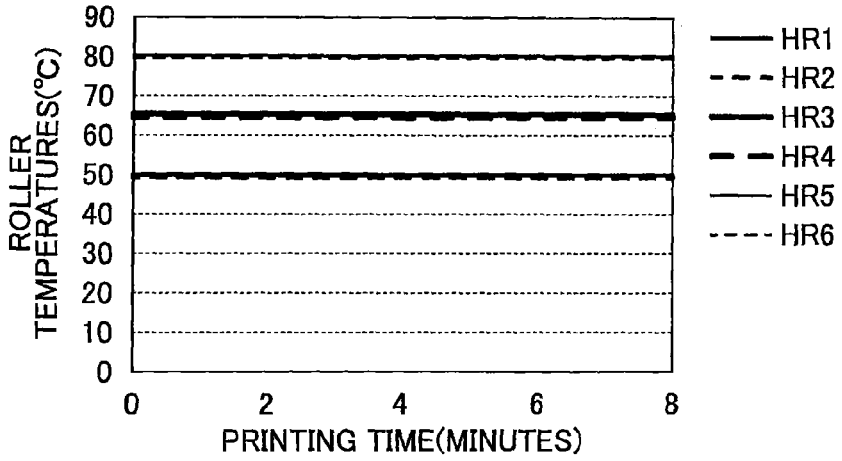
FIG. 5A is a graph illustrating setting temperatures of heating rollers as a comparative example.
Figure 5B:
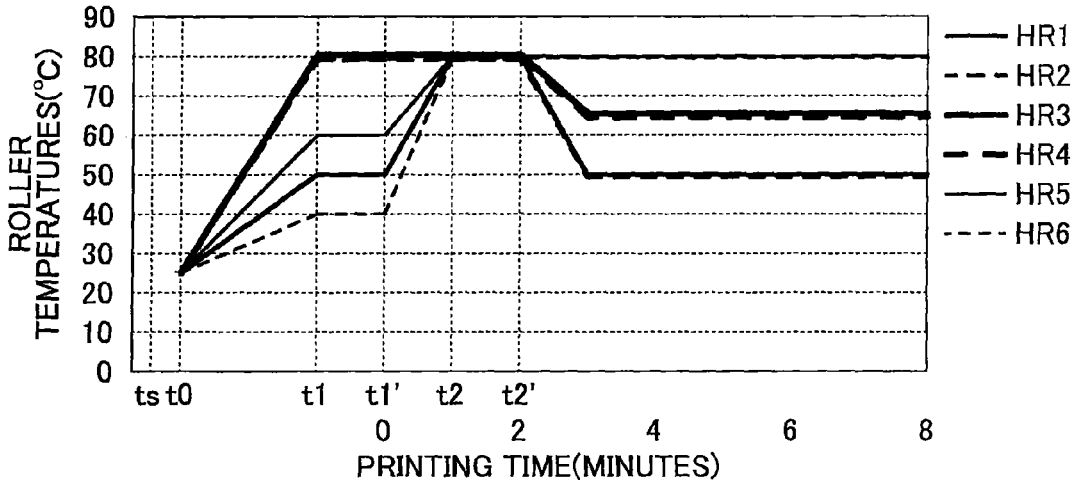
FIG. 5B is a graph illustrating setting temperatures of the heating rollers according to the first embodiment and the second embodiment of the present invention.

The schematic temperature control of the drying process in the heating/drying device 120 is described below. FIG. 3 is a control flowchart of the system (printing apparatus) 100. The flow relating to heating is mainly described. Herein, FIG. 5A is a graph illustrating temperatures of the heating rollers based on the temperature gradient, as a comparative example. FIG. 5B is a graph illustrating setting temperatures of the heating roller according to one example of the embodiments (first and second embodiments) of the present invention. The example of the FIG. 5B shows the temperature transition of the setting temperature in a case where coated paper A, pattern A, conveyance speed 50 mpm, and 80° C. of the maximum value of the settings temperatures having temperature gradient are used (which corresponds to the temperatures of TABLE 3 of the second embodiment, and the temperature transition of the setting temperature is similar to this graph).

In FIG. 3, when a print start is commanded from the control panel 91 and the PC/server 92 at step S100, the system 100 starts a printing preparation process (timing is shown in FIG. 5B, step S101).

As the printing preparation process (S102), the printing controller (host apparatus) 90 recognizes the information of the printing type, the information of the recording medium 10, the information of the conveyance of the recording medium 10, acquired from the control panel 91 and the PC/server 92, so as to determine the setting temperatures. The information of the printing types means that the printing is one-side (front side only or back side only) or duplex printing. The information of the recording medium is what type the recording medium is (normal or coated paper) or how wide the recording paper is, and how long the recording medium (paper roll) is. The conveyance information means the conveyance speed (printing speed), conveyance amount (the number of copy pages).

At S103, the CPU 87 included in the controller 80 of the heating/drying device 120 selects the suitable (optimum) temperature tables, for example TABLE 2, that shows combinations of the suitable first, second and third step setting temperatures, from the memory 88, in accordance with the information of the recording medium 10 acquired at step S102.

TABLE 2

| | REQUIRED | SETTING TEMPERATURE | | |
|---|---|---|---|---|
| | HEATING AMOUNT HAVING TEMPERATURE GRADIENT | FIRST SETTING TEMPERATURE IN STARTING | SECOND SETTING TEMPERATURE UPPER LIMIT TEMPERATURE | THIRD SETTING TEMPERATURE HOMOGENEOUSLY IMPARTING AMOUNT OF HEAT |
| FIRST STEP BACK-SIDE HEATING ROLLER 40a | 50 | 50 | 70 | 50 |
| FIRST STEP FRONT-SIDE HEATING ROLLER 40b | 50 | 70 | 70 | 50 |
| SECOND STEP BACK-SIDE HEATING ROLLER 50a | 60 | 70 | 70 | 60 |
| SECOND STEP FRONT-SIDE HEATING ROLLER 50b | 60 | 70 | 70 | 60 |
| THIRD STEP BACK-SIDE HEATING ROLLER 60a | 70 | 55 | 70 | 70 |
| THIRD STEP FRONT-SIDE HEATING ROLLER 60b | 70 | 40 | 70 | 70 |

Herein, as for the ink drying, TABLE 2 shows the temperature transition of the setting temperatures in a case where coated paper B, pattern B, conveyance speed 30 mpm, and 70° C. of the maximum value of the setting temperatures having the temperature gradient (continuous drying temperature) are used. In the setting of TABLE 2, while the upper limit temperature (second setting temperature) is 70° C., as a combination of the first setting temperatures, the temperature of the heating roller 60*b* positioned on the most downstream side (hereinafter most downstream heating roller 60*b*) is set to 40° C., and the temperature of the heating roller 60*a* positioned on the second-most downstream side (hereinafter second-most downstream) is set to 55° C. Herein, even when the heating rollers 40*a* through 60*b* are heated according to the setting temperature table of TABLE 2, the heat amount required for the above-described drying can be entirely ensured.

As the first setting temperature in starting (starting temperatures), the temperatures are set such that, the temperature of the most downstream heating roller 60*b* is 40° C., the temperature of the second-most downstream heating roller 60*a* is 55° C., the temperature of the heating roller 40*a* positioned on the most upstream side (most upstream heating roller 40*a*) is 50° C., and the heating rollers 40*b*, 50*a*, and 50*b* positioned on the inside area (center area) is 70° C. that is required for drying.

Figure 4:
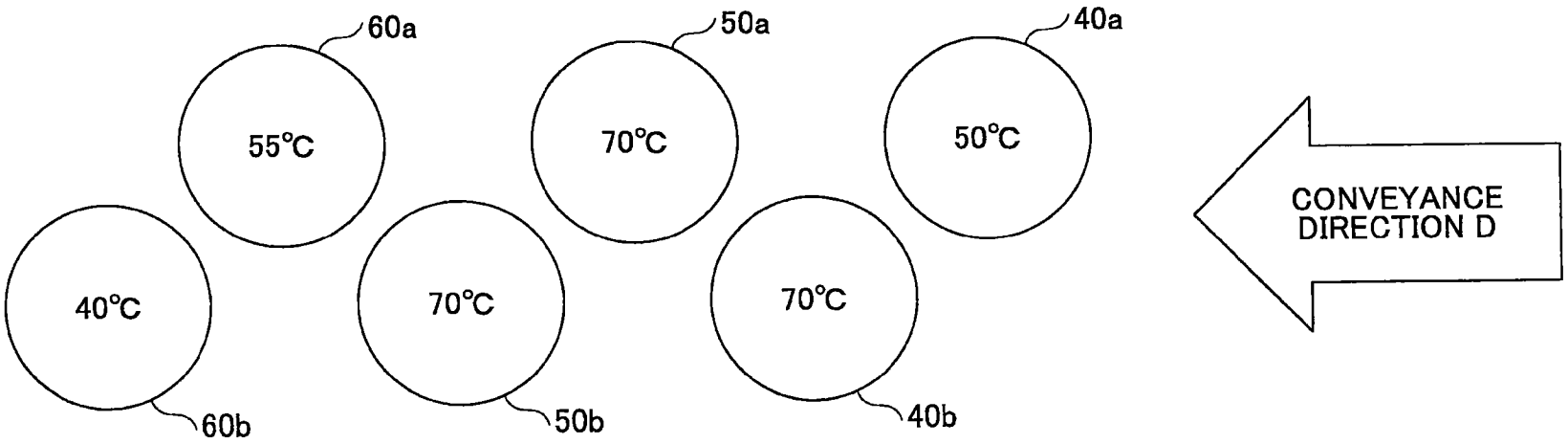
FIG. 4 is a schematic diagram of the temperatures of the first setting temperature of the heating rollers.

FIG. 4 is a schematic diagram of the rollers and the first setting temperatures of the present embodiment. With this setting, the sheet shrinkage in the recording medium 10 caused by the temperature-humidity difference between the contact area contacting the heating roller 60*b* and an area of the recording medium 10 positioned outside on the downstream of the heating/driving device 120 can be alleviated. Further, by setting such that the temperature difference between the heating rollers 50*b* and 60*a* and between the heating rollers 60*a* and 60*b* are set to 15° C., the temperature gradually changes. Changing the amount of sheet shrinkage of the recording medium 10 due to the temperature difference among the heating rollers can be alleviated, and to achieve the effect to reduce the occurrence of cockling in the recording medium entirely.

Further, by setting the most upstream heating roller 40*a* to 50° C., the sheet shrinkage of the recording medium 10 caused by the temperature-humidity difference between the contact area contacting the heating roller 40 and the area positioned outside on the entrance side of the heating/driving device 120 can be alleviated. At this time, the temperature difference between the most upstream heating roller 40*a* and the second-most upstream heating roller 40*b* is set to 20° C., and the recording medium 10 continuously comes in contact with the heating rollers 40*b*, 50*a*, and 50*b* inside the heating/drying device 120. Thus, the shrinkage difference among located positions in the recording medium 10 can be alleviated, and the cockling between the most upstream heating roller 40*a* and the second-most upstream heating roller 40*b* cannot occur.

Herein, in the first setting temperature, the temperatures of the heating rollers 40*a* through 60*b* cannot be increased gradually, and the amount of heat imparted to the respective heaters (heater lamps) 41*a* through 61*b* cannot be made equal. However, the final temperatures (third setting temperatures) during printing is set to the temperatures whose amounts of heat imparted during the respective steps of the heaters can be made equal. Accordingly, the third setting temperature corresponding to amount of heat equally imparted to the respective steps can be independently set.

Based on a print start command from the printing controller 90, at S104, in the controller 80 of the heating/drying device 120, with reference to the temperature table, the heating controllers 81 through 86 heat the heating rollers 40*a* through 60*b* toward the first setting temperature (starting temperatures) (at the timing t0 in FIG. 5B).

Subsequently, at S105, the controller 80 determines whether the respective heating rollers 40*a* through 60*b* are heated to the first setting temperatures, based on the outputs of the respective temperature sensors 42*a* through 62*b*, at the timing t1 shown in FIG. 5B. Then, when the heating rollers 40*a* through 60*b* have been raised to the respective first setting temperatures (Yes at S105), the controller 80 reports that the printing preparation is finished to the printing controller 90, thereby starting the printing.

At step S106, the printing controller 90 controls the conveyance controller 94 such that the sheet feeding apparatus 130 and the respective conveyance rollers 113, 30, and 71 are driven to convey the recording medium 10. At this time, the image forming units 111 and 112 of the image forming apparatus 110 start operation, to start the printing operation to eject the ink to the recording medium 10 onto the recording medium 10.

Along with the conveyance at S106, in the starting period during which the printing is started and the conveyance of the recording medium 10 is started, the temperatures of the heating rollers 40*a* through 60*b* are all increased toward the same second setting temperature (timing t1' shown in FIG. 5B). Herein, in the present embodiment, the second setting temperature has the same values as the maximum value of the continuous drying setting temperatures having the temperature gradient.

Next, while the temperatures are shifted, it is a risk that the time period during which the temperature of the most downstream heating roller 60*b*, positioned closest to the exit side to the conveying path, is increased from 40° C. to 70° C. is shorter than the time period during which the temperature of the second-most upstream heating roller 40*b* is decreased from 70° C. to 50° C., the total heat amount required for drying the recording medium 10 may be lacking. There is a large possibly that, the period of the temperature increasing of the heating roller 60*b* and the period of the temperature decreasing of the heating roller 40*b* may change, depending on the types of the recording medium 10, the adhesion amount of ink, and the external circumferences. Accordingly, as one countermeasure to prevent the lack of the total heat amount required for drying the recording medium 10, all the heating rollers 40*a* through 60*b* are increased to the upper limit temperatures for the moment.

Thus, when the controller 20 confirms that all the heating rollers 40*a* through 60*b* have been raised to the second setting temperature (Yes at S107, timing t2 shown in FIG. 5B), the heating controllers 81 through 86 change the temperatures of the heating rollers 40*a* through 60*b* from the second setting temperatures to the third setting temperatures so that the imparting amounts of heat based on the increase in temperature for respective steps can be made equal. Alternatively, like that shown in FIG. 5B, after all the heating rollers 40*a* through 60*b* have been raised to the second setting temperature, the second setting temperature may be kept for the predetermined period. (time period t2-t2" shown in FIG. 5B). While heating at the third setting temperature, the continuous printing operation (continuous drying) is performed (S108).

Subsequently, the printing controller 90 determines whether the printing controller 90 finishes the printing job, that is, whether or the image forming apparatus 110 finishes image formation (ink ejection), at S109.

After the printing operation is finished, the control system 500 determines whether an end (trailing edge) of the image forming area of the recording medium 10 on which the ink lands, has been discharged from the heating/drying device 120 functioning as the ink drying apparatus. Whether or not the end of the image forming region of the recording medium 10 is discharged from the heating/drying device 120 is determined, based on the ink ejection timing of the image forming units 111 and 112, and the conveyance timing of the respective conveyance members such as the rollers 113, 30, and 71. For example, a required time is calculated from the conveyance distance and the conveyance speed of the recording medium 10, and the calculated required time is compared with the time count result, so as to execute the determination.

After the end of the image forming region of the recording medium 10 is discharged from the exit 79 of the heating/drying device 120, the controller 80 turns the respective heaters 41*a* through 61*b* OFF, and stops drying with the heating/drying device 120 (S110).

Then, the conveyance controller 94 of the control system 500 stops driving the sheet feeding apparatus 130 and the respective conveyance rollers 113, 30, and 71, and stops conveyance of the recording medium 10 (whole conveyance). Thus, the process is completed (S112).

With this control, the present embodiment of the present invention keeps the temperatures state whose amounts of heat imparted to the respective heaters can be made equal, which can prevent breaking the temperature settings whose temperatures have a temperature gradient where the temperature gradually increases from upstream side to downstream side during continuous printing. Accordingly, since rapid temperature increase in the recording medium 10 can be avoided, the system 100 including the heating/drying device 120 can minimize the heat load exerted on the recording medium 10. Thus, suffering the damage such as wrinkling and deforming of the recording medium 10 due to the heat load can be suppressed.

In addition, in the starting period, in a condition where the amount of heat required for ensuring the drying of the sheet is kept, in order to avoid the cockling occurring in the downstream side, by setting the setting temperatures of the most and the second-most downstream of the heating rollers 60*a* and 60*b* to the low temperatures, and by reducing the temperature difference between the heating/drying device 120 and the outside, the partial shrinkage difference of the recording medium can be prevented.

Furthermore, in order to avoid a mild degree of the cockling occurring in the upstream side in the starting period, by setting the most upstream roller being of the heating roller 40*a* to the low temperature, and by reducing the temperature difference between the heating/drying device 120 and the outside, the partially shrinkage difference of the recording medium 10 occurring in the area close to the entrance of the heating/drying device 120 can be prevented.

As described above, in the starting period, this control can eliminate the change (difference) in the humidity and temperature difference due to drying and absorbing moisture of the ink on the entrance side and the exit side of the heating/drying device 120, and the difference in the water content of the recording medium 10, to greatly lessen the cockling, such as wave-shaped deformation. Thus, preferable winding up and folding the recording medium 10 can be performed in the foregoing process, without damaging the recording medium.

Variation of First Embodiment

Furthermore, as a variation of the present embodiment, additional rollers are provided downstream of the above-described heating rollers, and apply the heat control techniques with the following the mechanical cockling prevention techniques. Thus, the great effect can be achieved. In the variation shown in FIG. 6, the recording medium 10 rapidly absorbs the moisture immediately after discharging from the exit of a heating/drying device 120-A, and the cockling phenomenon is significantly likely to occur near the exit of the heating/drying device 120-A. In order to solve this problem, a cockling suppression mechanism (cockling suppression device) 20 is disposed on the downstream of the exit of the heating/drying device 120-A, In the variation of the present embodiment shown in FIG. 6, in the cockling suppression mechanism 20, multiple hollow driven rollers 21 are arranged in the conveyance direction, which forms a winding conveyance path 22 that bends in the conveyance direction multiple times. Specially, in the cockling suppression mechanism 20 provided downstream of the heating/drying device 120-A of FIG. 6, the winding conveyance path 22 is formed such that the conveyance path 22 winds in vertical direction that is orthogonal to the conveyance direction of the recording medium 10 extending in a horizontal direction.

In the winding conveyance path 22 constituted by the multiple hollow driven rollers 21, it is preferable that the shaft distances among the shafts of the adjacent driven rollers 21 is set such that the shaft distance is shorter as the driven roller 21 is closer to the heating/drying device 120-A (D3>D2>D1). As one example, from a start point of the driven roller 21 positioned on the exit side of the heating/drying device 120-A, the shaft distance between the driven rollers 21 is 50, 75, 100, . . . and so on (from upstream side to downstream side).

The reason why the shaft distances between the driven rollers 21 are set such that the shaft distance is shorter as the driven roller 21 is closer to the heating/drying device 120-A, is that, when the outer diameters are same, the winding angle becomes greater as the shaft distance is shorter. When the winding angle is greater, the pressure area is made wider by the recording medium 10 being pressed by the driving rollers 21, and the free extension is restricted. Further, unevenness of the temperature and the humidity and temperature change in the sheet width direction of the recording medium 10 can be prevented by contacting the recording medium 10 with the driven rollers 21. In addition, the rigidity of the recording medium 10 can be increased, by setting greater winding angles.

In addition, in the above-described cockling suppression mechanism 20, since the driven rollers 21 bends (curls) the recording medium 10 multiple times, compared to the case where the conveyance path curls only one time, the position relation of the respective driven rollers 21 can divide the deformation of the recording medium 10, without growing the cockling (wave-shaped deformation) of the recording medium 10. In particular, the freely deformation is sustained in the recording medium 10 by contact areas with the recording medium 10. Thus, the cockling can be prevented in steps. The cockling deformation in the recording medium 10 can be also prevented, in a wide range in the conveyance direction.

Accordingly, it becomes less likely for the cockling to occur, which cockling is a wave-shape deformation formed in parallel to the conveyance direction that is orthogonal to the width direction of the recording medium 10, during the standby state.

In the present variation, in particular, in a case where the total heat amount is great, for example, for thick paper in a state where coated paper C of TABLE 1, the temperatures of the third step of the heating roller (most downstream) to which the maximum value of the setting temperatures having the temperature gradient is high (equal to or greater than 90° C.) are used, if the setting temperature in starting the most downstream heating roller is too low during starting, it takes more time to increase the temperatures of the heating rollers. Alternatively, even when the time at which the process proceeds to the continuous driving has come, the setting temperature (especially the most downstream heating roller) having a temperature gradient cannot be accomplished. Thus, in order to converge the difference between the starting temperature and the upper limit temperature within 30° C. to 40° C. such as *1 and *3 of TABLE 1, when the maximum value of the setting temperatures having the temperature gradient 100° C. such as *4 of TABLE 1 is used, it is desirable that the minimum temperature during activating be set to 60° C. to 70° C.

As described above, in a case where the required total heat amount is great and applying higher temperature to the most downstream heating roller **60*b* is required, even when the temperature is set to be lower than the setting temperatures having the temperature gradient in starting, there is a risk of cockling occurring in the recording medium 10**. In this case, it is preferable that the cockling suppression mechanism like that of the present variation can be provided.

Furthermore, on the entrance side of the heating/drying device 120-A, although the degree of the deformation is small, the cockling of the recording medium 10 may occur. Thus, the winding conveyance path may be provided on the entrance side, similarly to the entrance side 22 shown in FIG. 6. In a case where the cockling suppression mechanism is provided on the entrance side, the winding conveyance path is formed such that the conveying path is waved in a direction orthogonal to an inclined conveyance direction. Yet alternatively, the cockling suppression mechanism 20 may be provided at either one of the vicinity of the upstream side or downstream side of the heating/drying device 120-A.

Second Embodiment

Figure 7:
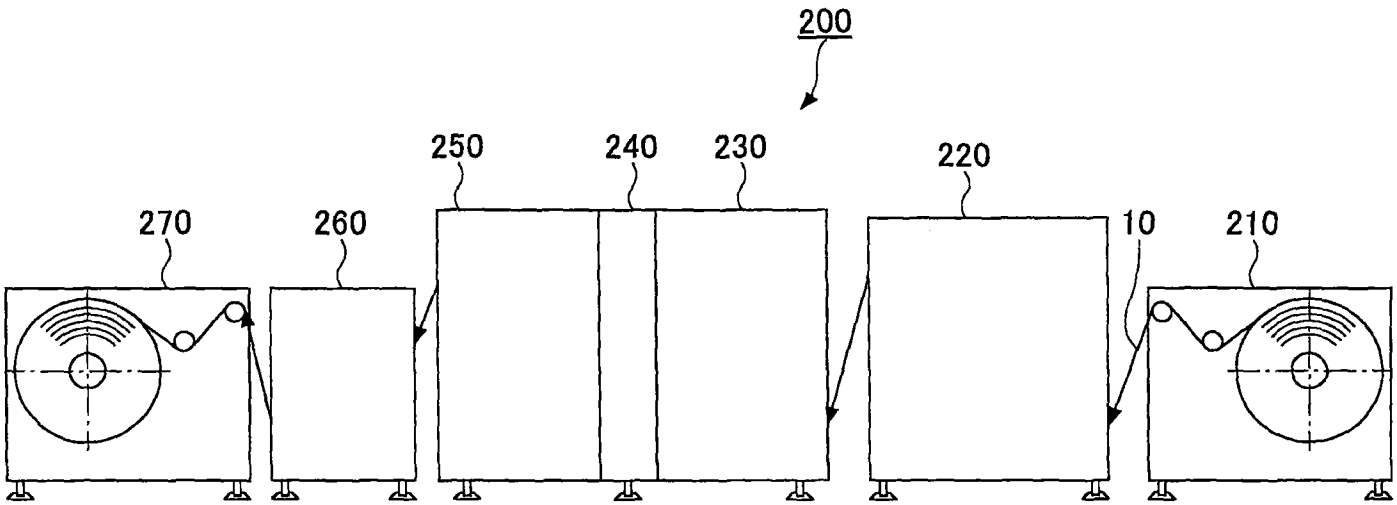
FIG. 7 is a schematic diagram illustrating a printing system according to the second embodiment of the present invention.
Figure 8:
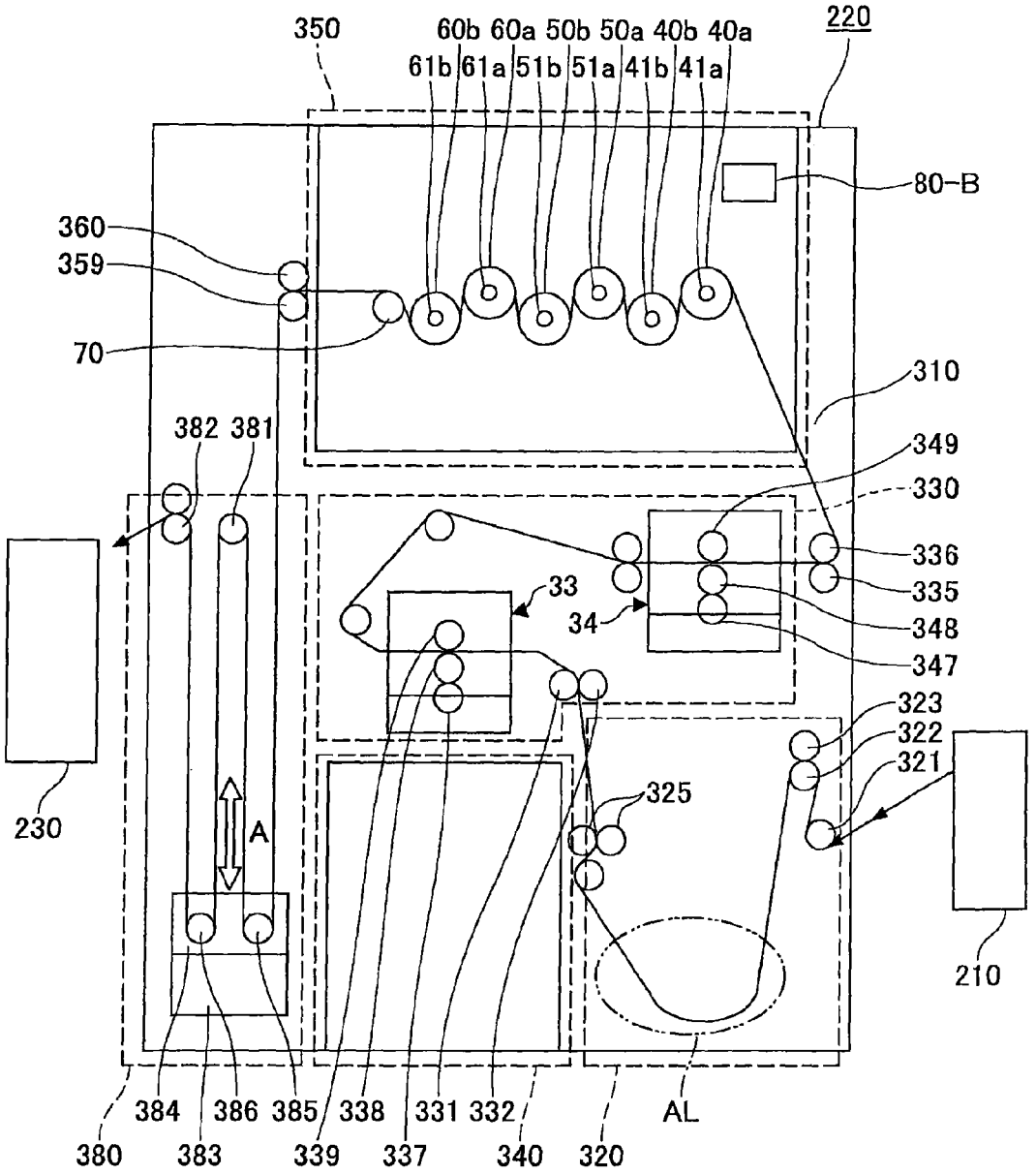
FIG. 8 is a schematic diagram illustrating a pretreatment liquid coating/drying apparatus used for the printing system shown in FIG. 7.
Figure 9:
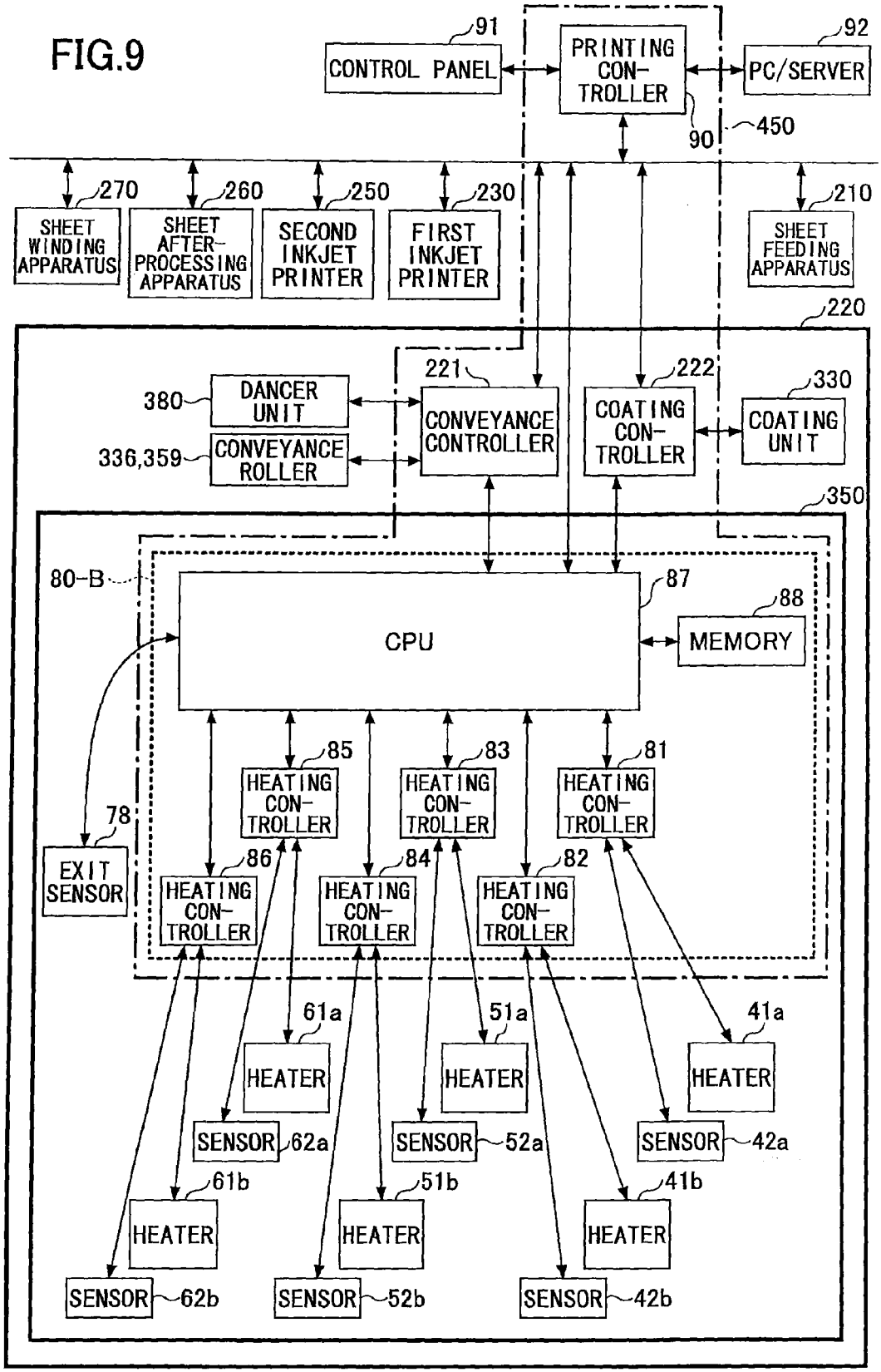
FIG. 9 is a control block diagram illustrating an entire printing system including the heating apparatus shown in FIG. 7.

Next, FIG. 7 shows a configuration of a printing system 200 including a pretreatment apparatus 220 including a drying unit 350 according to a second embodiment of the present invention. FIG. 8 is an entire configuration of the pretreatment apparatus 220. FIG. 9 is a control block diagram of the entire system shown in FIGS. 7 and 8. Herein, the description of the components similar to those of the components in the first embodiment is omitted by being attaching identical reference numerals, and the difference is mainly described.

FIG. 7 is a schematic diagram illustrating the printing system 200 according to the second embodiment of the present invention. In FIG. 7, the printing system 200 includes a sheet feeding apparatus 210, the pretreatment apparatus (pretreatment liquid coating/drying apparatus) 220, a first inkjet printer 230, a sheet reverse apparatus 240, a second inkjet printer 250, an after heating apparatus 260, and a sheet winding apparatus (sheet after-processing device) 270.

FIG. 8 is a schematic diagram illustrating an entire configuration of the pretreatment apparatus 220 included in the printing system 200 shown in FIG. 7.

As shown in FIG. 7, the sheet feeding apparatus 210 feeds the recording medium (elongated continuous sheet) 10, which is winding to a rolled shape, to the pretreatment apparatus 220 having a coating device 330.

The pretreatment apparatus 220 functions as a pretreatment liquid coating/drying apparatus for the recording medium 10. In order to solve the problems such as image blur, image concentration change, color tone change, image show-through etc., the pretreatment apparatus 220 applies a pretreatment liquid, that has a function to coagulate ink to be applied to an image forming surface of the recording medium 10, to the recording medium 10. The pretreatment apparatus 220 applies and dries the pretreatment liquid on the recording medium 10, and then discharges the recording medium 10 to the first inkjet printer 230.

The pretreatment apparatus 220 is provided with a drying unit 350 to dry the pretreatment liquid on the recording medium 10. Herein, the drying unit 350 included in the pretreatment apparatus 220, having identical configuration to the above-described heating/drying device 120 that includes the heating rollers 40*a* through 60*b*. Further, also in the drying unit 350, a controller 80-B executes the above-described control processes (see FIG. 9), to control the heaters 41*a* through 61*b* of the respective heating rollers 40*a* through 60*b*, similarly to the first embodiment.

The first inkjet printer 230 ejects the ink droplets to the front-side (face) of the recording medium 10 to which the pretreatment liquid is applied in the pretreatment apparatus 220, to form a desired image based on the image data.

When performing duplex printing, thereafter, the reverse device 240 reverses the sides of the recording medium 10, which is then fed to the second inkjet printer 250. The reverse device 240 include a dryer (not shown) to dry the front side (face) of the recording medium 10 onto which the image is formed by the first inkjet printer 230 to dry the ink.

The second inkjet printer 250 ejects the ink droplets to the back-side (face) of the recording medium 10, reversed by the reverse device 240, to form a desired image based on the image data.

The after-drying apparatus 260 includes a dryer (not shown) to dry the image formed on the both sides of the recording medium 10, using hot wind from the dryer.

The sheet winding apparatus 270 winds up and collects the recording medium 10 onto which the images are formed on both sides where the ink of the image is dried.

Next, with reference to FIG. 8, the configuration of the pretreatment apparatus 220 is described. The pretreatment apparatus 220 includes the pretreatment liquid coating device (pretreatment liquid coating unit) 330. In order to dry the pretreatment liquid on the recording medium 10, the drying unit (recording medium heating device) 350 is disposed downstream from the pretreatment liquid coating device 330 in the conveyance direction D of the recording medium 10.

Further, the pretreatment apparatus 220 includes an air loop unit 320, a pretreatment liquid supply unit 340, and a dancer unit 380, in addition to the pretreatment liquid coating device 330 and the drying unit 350.

The air loop unit 320 includes a guide roller 321, a feed in (FI) roller 322, and a FI nip roller 323, which rollers are rotatably supported therein.

In the air loop unit 320, the guide roller 321, the FI roller 322 that drives to rotate, and the FI nip roller 323 driven to rotate, guide the recording medium 10 fed from the sheet feeding apparatus 210 inside the air loop unit 320. At this time, an optical sensor controls the rotation of the FI roller 322 so that the amount of slack of the recording medium 10 is constant in an air loop AL. After the recording medium 10 passes through the air loop AL, while a tension force from tension shafts, for stabilizing the conveyance of the recording medium 10, is being exerted onto the recording medium 10, the recording medium 10 is conveyed to the pretreatment liquid coating device 330.

After passing through the air loop AL, the recording medium 10 is conveyed between two edge guides and is conveyed in the shape of S, between two path shafts 325 whose longitudinal direction is arranged orthogonal to a width direction of the recording medium 10. The two path shafts 325 are supported by the edge guides, and the interval between the edge guides is designed to be a same length of the width of the recording medium 10. Herein, the edge guide is movably fixed to the path shaft 325 by a fixing tool such as screw, and the interval between the edge guides is adjusted based on the width of the recording medium 10 to be used. Due to the functions of the path shafts 325 and the edge guides (not shown) orthogonal thereto, a moving position of the recording medium in the width direction is restricted, which enables conveying the recording medium stably.

After passing through the path shafts 325 and the edge guides, a tension force from the stable rotating tension shaft is exerted onto the recording medium 10 to achieve stable conveyance.

The pretreatment liquid coating device 330 includes a rotatable in-feed roller 331 and a rotatable in-feed nip roller 332, a back-side coating unit 33 and a front-side coating unit 34. Further, an out-feed roller 335 and an out-feed nip roller 336 are provided in the treatment liquid coating device 330. The in-feed nip roller 332 presses against the in-feed roller 331 to convey the recording medium 10, and the out-feed nip roller 336 presses against the out-feed roller 335 to convey the recording medium 10. The feed rollers 331, 335 and the feed nip rollers 332, 336 function as conveyance members.

The backside coating unit 33 includes a squeeze roller 337, a coating roller 338, and a pressure roller 339. In the back-side coating unit 33, the squeeze roller 337 supplies the treatment liquid to the coating roller 338. In the back-side coating unit 33, the squeeze roller 337 supplies the treatment liquid to the coating roller 338. While the recording medium 10 is being conveyed while being clamped between the coating roller 338 and the pressure roller 339, one side (back side) of the recording medium 10 is being coated with the treatment liquid by the coating roller 338. After passing through the back-side coating unit 33, the recording medium 10 is conveyed to the front-side coating unit 34.

The front-side coating unit 34 includes a squeeze roller 347, a coating roller 348, and a pressure roller 349. After passing through the front-side coating unit 34, the recording medium 10 is conveyed to the drying unit 350 (recording medium heating device), using the out-feed roller 335 and the out-feed nip roller 336.

Herein, the back-side coating unit 33 and the front-side coating unit 34 can be operated selectively, and the pretreatment liquid may be applied to both sides, or either front side or back side of the recording medium 10.

The pretreatment liquid supplying unit 340 retains the treatment liquid, and supplies the pretreatment liquid to the back-side coating unit 33 and the front-side coating unit 34.

In this embodiment, the components of the drying unit 350 are similar to those configurations of the components in the heating/drying device 120 shown in FIG. 1, and the drying unit 350 has a function to heat the recording medium 10 and dry the pretreatment liquid applied to the recording medium 10. Herein, the description of the components similar to those configurations of the components in the heating/drying device 120 shown in FIG. 1 is omitted by having identical reference numerals.

The drying unit 350, having a similar configuration to the above-described heating/drying device 120, includes the heating rollers 40*a*, 40*b*, 50*a*, 50*b*, 60*a*, and 60*b* from upstream side to downstream side in the convey direction D of the recording medium 10, and a controller 80-B.

Further, in the drying unit 350, the controller 80-B executes the above-described control processes (see FIG. 3), and controls the heaters 41*a* through 61*b* of the respective heating rollers 40*a* through 60*b*, similarly to the first embodiment.

The heating rollers 40*a* through 60*b* are arranged in two rows and in a zigzag state. The recording medium 10, which is wound around the respective heating rollers 40*a*, 40*b*, 50*a*, 50*b*, 60*a*, and 60*b* in this order, is conveyed in the drying unit 350 by the out-feed roller 335 and the feed nip roller 336, and a feed roller 359 and a feed nip roller 360. The respective heating rollers 40*a* through 60*b*, which are driven and rotated depending on the conveyance of the recording medium 10, heat the recording medium 10 and dry the pretreatment liquid applied to the recording medium 10.

Herein, the rotation of the heating rollers 40*a* through 60*b* is driven with the conveyance of the recording medium 10, so that it is not necessary to provide the motor as a driving source to drive and rotate the heating rollers 40*a* through 60*b*, which can save the space for providing the motors and allow the pretreatment apparatus 220 to become compact.

Further, in the drying unit 350, the recording medium 10 on which the pretreatment liquid is applied and dried is clamped between the driving feed roller 359 and the feed nip roller 360 to convey the recording medium 10 to the dancer unit 380.

The dancer unit 380 includes two guide rollers 381 and 382, a movable frame 384, a position detector to detect the position of the movable frame 384, and dancer rollers 385 and 386 attached to the movable frame 384. The movable frame 384, to which a weight 383 is attached in a lower portion, is provided movable with the dancer rollers 385 and 386 in directions indicated by an arrow A. The recording medium 10 is wound around the guide rollers 381 and 382 and the dancer rollers 385 and 386 in the shape of W.

The dancer unit 380 controls the conveyance amount of the feed roller 359 based on the output of a position detector, so as to adjust the position of the movable frame 384 in the vertical direction. The position of the movable frame 384 is adjusted, which enables ensuring a buffer of the recording medium 10 between the pretreatment apparatus 220 and the following first inkjet printer 230.

The recording medium 10 heated by the drying unit 350 is cooled in the dancer unit 380 and is conveyed to the following first inkjet printer 230.

With this configuration, the pretreatment apparatus 220 applies the pretreatment liquid to the recording medium 10 for preventing the ink bleeding and helping ink permeation so as to improve the image quality. Then, the drying unit 350 evaporates the pretreatment liquid on the recording medium 10. The recording medium 10 is cooled in the dancer unit 380 and is conveyed to the first inkjet printer.

It is to be noted that, the pretreatment liquid coating device 330 functions as a pretreatment device to apply the pretreatment liquid to the front side (surface), back side, or both sides of the recording medium 10. The drying unit (recording medium heating device) 350 functions as a pretreatment liquid drying device to evaporate the pretreatment liquid on the recording medium 10.

With this configuration, the pretreatment apparatus 220 applies the pretreatment liquid to the recording medium 10 for preventing the ink bleeding and helping ink permeation so as to improve the image quality, and then conveys the recording medium 10 to the following first inkjet printer 230. The pre-treatment apparatus 220 applies the pretreatment liquid to front side (face), back side or both sides of the recording medium.

The controller 80-B controls the heaters 41*a* through 61*b* such that the total amount W of heat applied from the heating rollers 40*a* through 60*b* to the recording medium 10 exceeds the amount sufficient to evaporate the moisture of the pretreatment liquid (dry the pretreatment liquid).

In addition, the controller 80-B changes the respective setting temperatures to adjust the heat amount of the respective heating rollers 40*a* through 60*b* based on the conveyance speed, types of the recording medium 10, the coating amount of pretreatment liquid (for example, coating pattern, applying to the both sides applying or either side).

FIG. 9 is a control block diagram illustrating the printing system 200 according to the second embodiment. As shown in FIG. 9, the controller 80-B of the drying unit 350 is included in the control system 450 of the printing system 200. The controller 80-B of the drying unit 350 includes the heating controllers 81 through 86 corresponding to the respective heating rollers 40*a* through 60*b*, CPU 87, and the memory 88. Herein, although it is not shown, the controller 80 further includes a RAM and a ROM storing a program to execute heating, an I/O (input/output terminal), and an I/F (interface) to receive the data from the printing controller 90.

The heating controllers 81 through 86, which are connected to the heaters 41*a* through 61*b* configured with halogen lamps, provided inside the heating rollers 40*a* through 60*b*, each include heater driving circuits, etc, respectively, to adjust an applying voltage to the heaters 41*a* through 61*b*. In addition, the heating controllers 81 through 86, which are connected to the temperature sensors 42*a* through 62*b*, control the heaters 41*a* through 61*b* such that the surface temperatures of the heating rollers 40*a* through 60*b* are adjusted within a predetermined temperature range.

The memory 88 stores multiple temperature tables as combinations of first setting temperatures (temperature in starting), a second setting temperature (upper limit temperature), and third setting temperatures (temperatures whose amounts of heat imparted to the respective steps is made equal, in continuous drying), based on types of recording media and/or conveyance speed.

The control system of the pretreatment apparatus 220 includes the controller 80-B of the drying unit 350, a coating controller 222 to control the pretreatment liquid coating units 33, 34 and a conveyance controller 221 to control the conveyance in the pretreatment apparatus 220. Further, the control system 450 is provided with the printing controller 90 that totally controls the printing system 200 including the pretreatment liquid coating/drying apparatus 220.

In the pretreatment liquid coating/drying apparatus 220, the coating controller 222 is connected to the front-side coating unit 34 and the back-side coating unit 33 for control. The conveyance controller 221, which is connected to the respective conveyance rollers 335 and 359, the dancer unit 380, and the air loop unit 320 provided inside the pretreatment liquid coating/drying apparatus 220, controls the conveyance of the recording medium 10 in the pretreatment liquid coating/drying apparatus 220.

As described above, the control system 450 is provided with the printing controller 90 that is connected to the printing system 200 including the pretreatment liquid coating/drying apparatus 220. Further, the printing controller 90, which is connected to the control panel 91, the PC/server 92, the sheet feeding apparatus 210, the first inkjet printer 230, the second inkjet printer 250, the after processing apparatus 260, and the sheet winding apparatus 270 via multiple data lines and control lines, totally controls the image forming operation containing ink drying.

The printing controller 90 totally controls the image forming operation including the pretreatment liquid drying. The controller 80-B of the drying unit 350 includes the heating controllers 81 through 86 corresponding to the respective heating rollers 40*a* through 60*b*, the CPU 87, and the memory 88. The CPU 87 controls the heating controllers 81 through 86 based on the information acquired from the connected coating controller 222, the conveyance controller 221 and the printing controller 90.

The controller 80-B controls the temperatures of the heaters 41*a* through 62*b* provided in the heating rollers 40*a* through 60*b* based on the temperatures of the respective heating rollers 40*a* through 60*b* detected by the temperature sensors 42*a* through 62*b*, and an operational state, such as the rotational velocity of the discharge conveyance roller 359 and/or the supplying conveyance roller 335.

In the present embodiment, in order to dry the pretreatment liquid, the heating controllers 81 through 86 control the heaters 41*a* through 61*b*, corresponding to the coating state of the front-side coating unit 34 and the back-side coating unit 33.

It is to be noted that, although the solvent of the ink is evaporated in the first embodiment, the point where the solvent of the pretreatment liquid is evaporated in the second embodiment is different. Other detailed control methods in the present embodiment is similar to the control methods in the above-described embodiment, so that the description thereof is omitted appropriately. Since the temperature transition setting method of the setting temperature is similar to that of the first embodiment, the required heat amount is set like that as the above-shown TABLE 1.

Control process (control flow) of FIG. 10 is executed such that any one of the required heating amount is selected and used and take the temperature transition like that shown in FIG. 5A. Also in the present embodiment, setting temperatures are changed for each time period, so as to alleviate the damage to the recording medium 10 caused by the first-step heating rollers 40*a*, 40*b* that initially contacts the recording medium during continuous printing and so as to alleviate the shrinkage of the recording medium 10 caused by the third-step heating rollers 60*a*, 60*b* provided on the exit side in the starting period.

Herein, the operation of the printing system 200 is described below, with reference to the flowchart shown in FIG. 10. The flow relating to the heating is mainly described. FIG. 10 is a control flowchart illustrating the printing system 200. In FIG. 10, when a print start is commanded from the control panel 91 and the PC/server 92 at step S200, the printing system 200 starts the printing preparation process (timing is in FIG. 5B, S201).

As the printing preparation process (S202), the printing controller (host apparatus) 90 recognizes the information of the printing type, the information of the recording medium 10, the information of the conveyance of the recording medium 10, acquired from the control panel 91 and the PC/server 92, so as to determine the setting temperatures. The information of the printing types means that the printing is one side (front side only or back side only) or duplex printing. The information of the recording medium is what type the recording medium is (normal or coated paper) or how wide the recording paper is, how long the recording medium (paper roll) is. The conveyance information means the conveyance speed (printing speed), and/or conveyance amount (the number of copy pages).

At S203, the CPU 87 included in the controller 80-B of the drying unit 350 selects the suitable temperature tables, for example TABLE 3, that shows combinations of the suitable first, second and third step setting temperatures, from the memory 88, in accordance with the information of the recording medium acquired at step S202.

TABLE 3

| | REQUIRED | SETTING TEMPERATURE | | |
|---|---|---|---|---|
| | HEATING AMOUNT HAVING TEMPERATURE GRADIENT | FIRST SETTING TEMPERATURE IN STARTING | SECOND SETTING TEMPERATURE UPPER LIMIT TEMPERATURE | THIRD SETTING TEMPERATURE HOMOGENEOUSLY IMPARTING AMOUNT OF HEAT |
| FIRST STEP BACK-SIDE HEATING ROLLER 40a | 50 | 50 | 80 | 50 |
| FIRST STEP FRONT-SIDE HEATING ROLLER 40b | 50 | 80 | 80 | 50 |
| SECOND STEP BACK-SIDE HEATING ROLLER 50a | 65 | 80 | 80 | 65 |
| SECOND STEP FRONT-SIDE HEATING ROLLER 50b | 65 | 80 | 80 | 65 |
| THIRD STEP BACK-SIDE HEATING ROLLER 60a | 80 | 60 | 80 | 80 |
| THIRD STEP FRONT-SIDE HEATING ROLLER 60b | 80 | 40 | 80 | 80 |

Herein, as for one example of the pretreatment liquid drying, the TABLE 3 shows the temperature transition of the setting temperature in a case where coated paper A, pattern A, conveyance speed 50 mpm, and 80° C. of the maximum value of the setting temperatures having the temperature gradient are used. (Please see *3 of TABLE 1, temperature transition shown in FIG. 5B). In the setting of TABLE 3, as a combination of first setting temperatures, the temperature of the most downstream heating roller 60*b* is set to 40° C., the temperature of the second-most downstream heating roller 60*a* is set to 60° C. Herein, even when the heating rollers are heated according to the setting table shown in the temperature table of TABLE 3, the heat amount required for the above-described drying can be entirely ensured.

Based on the print start command from the printing controller 90, at step S204, the heating controllers 81 through 86 of the controller 80-B of the drying unit 350 start heating the heating rollers 40*a* through 60*b* toward the defined first setting temperature (temperature in starting) (t0 of FIG. 5B)

Subsequently, at S205, the controller 80-B determines whether the respective heating rollers 40*a* through 60*b* are heated to the first setting temperature, based on the outputs of the respective temperature sensors 42*a* through 62*b*, at the timing t1 of FIG. 5B. Then, when the heating rollers 40*a* through 60*b* have been raised to the respective first setting temperatures (Yes at S205), the controller 80-B reports the coating preparation finishing to the printing controller 90, thereby starting coating (applying).

At step S206, before image formation, the printing controller 90 controls the conveyance controller 221 such that the sheet feed apparatus 210 and the respective feed rollers 322, 331, 335, and 359 are driven to convey the recording medium 10 (Convey ON). At this time, the coating controller 222 operates the pretreatment liquid coating unit 33, 34 to apply the pretreatment liquid to the recording medium 10.

In the starting period during which coating is started (S206), the temperatures of the heating rollers 40*a* through 60*b* are all increased toward the same second setting temperature (timing t1' shown in FIG. 5B). Herein, in the present embodiment, the second setting temperature has the same value as the maximum value of the continuous drying setting temperatures having the temperature gradient.

Subsequently, the printing controller 90 of the control system 450 activates the first inkjet printer 230, and then the second inkjet printer 250 to start printing (S207).

Thus, after the controller 80-B confirms that the heating rollers 40*a* through 60*b* have been raised to the second setting temperature (Yes at 5208, t2 of FIG. 5B), the heating controller 81 through 86 changes the temperatures of the heating rollers 40*a* through 60*b* from the second setting temperature to the third setting temperatures whose amounts of heat imparted to the respective steps is made equal (S209). Alternatively, as shown in FIG. 5B, the second setting temperature may be kept for the predetermined period. (t2-t2" of FIG. 5B). While heating at the third setting temperature, the continuous printing operation (continuous drying) is performed.

It is to be noted that, in this flow, after the printing operation of the head unit 231 of the first inkjet printer 230 has been started, the temperatures of the heating rollers 40*a* through 60*b* are shifted to the third setting temperatures. However, when the controller 80-B determines that all the heating rollers 40*a* through 60*b* have been raised to the second setting temperatures, before the leading edge of the recording medium 10 where the pretreatment liquid is applied reaches the head unit 231, the temperature of the heating rollers 40*a* through 60*b* are shifted (raised) to the third setting temperatures.

Subsequently, the printing controller 90 of the control system 450 determines whether applying the pretreatment liquid is finished at S210.

Then, the controller 80-B in the control system 450 determines whether an end of a coated region of the recording medium 10 that is coated with the pretreatment liquid is discharged from the drying unit 350 (S211). Whether or not the end of the coated region of the recording medium 10 that is coated with the pretreatment liquid is discharged from the heating unit 350 is determined based on the coating timing of the coating units 33 and 34, the conveyance timing of the respective conveyance members such as rollers 335, 359, 382, and the position of the movable frame 384. For example, a required time is calculated from the conveyance distance and the conveyance speed of the recording medium 10, and the calculated required time is compared with the time count result, so as to execute the determination.

After the end of the coated region of the recording medium 10 is discharged from the drying unit 350, the heat controllers 81 through 86 of the controller 80-B turn the respective heaters 41*a* through 61*b* OFF, the and stops drying the drying unit 350 (S212).

Then, the printing controller 90 of the control system 450 causes the conveyance controller 221 of the pretreatment liquid coating/drying apparatus 220 and the conveyances controller 94 to stop conveying the recording medium 10, using the conveyance members 355 and 70. Thus, the process is completed (S213).

With this control, the present embodiment of the present invention, keeps the temperature state whose amounts of heat imparted to the respective heaters in the heating rollers is made equal in continuous drying which can prevent breaking the temperature settings having temperature gradient where the temperature gradually increases from upstream side to downstream side during continuous printing. Accordingly, since rapid temperature increase in the recording medium 10 can be avoided, the printing system 200 including the drying unit (recording medium heating device) 350 can minimize the heat load exerted on the recording medium 10. Thus, suffering the damage such as wrinkling and deformation of the recording medium 10 due to the heat load can be suppressed.

In addition, in the starting period, in a condition where the amount of heat required for ensuring the drying of the sheet is kept, in order to avoid the cockling occurring in the downstream side, by setting the setting temperatures of the most and the second-most downstream of the heating rollers 60*a* and 60*b* to the low temperatures, and by reducing the temperature difference between the drying unit 350 and the outside, the partial shrinkage difference of the recording medium 10 can be prevented.

Furthermore, in order to prevent mild degree of the cockling occurring in the upstream side in the starting period, by setting the most upstream roller being of the heating roller 40*a* to a low temperature, and by reducing the temperature difference between the drying unit 350 and the outside, the partial shrinkage difference of the recording medium 10 occurring in the area close to the entrance of the drying unit 350 can be prevented.

As described above, in the starting period, this control can eliminate the change (difference) in the humidity and temperature difference due to drying and absorbing moisture on the entrance side and the exit side of the drying unit 350, and the difference in the water content of the recording medium 10, to greatly lessen the cockling, such as wave-shaped deformation. Thus, in the foregoing process, without damaging the recording medium 10, the preferable image forming process can be performed in the inkjet printers 230 and 250, and winding up the recording medium 10 in the sheet winding apparatus 270 can be preferably performed.

Variation of Second Embodiment

Figure 11:
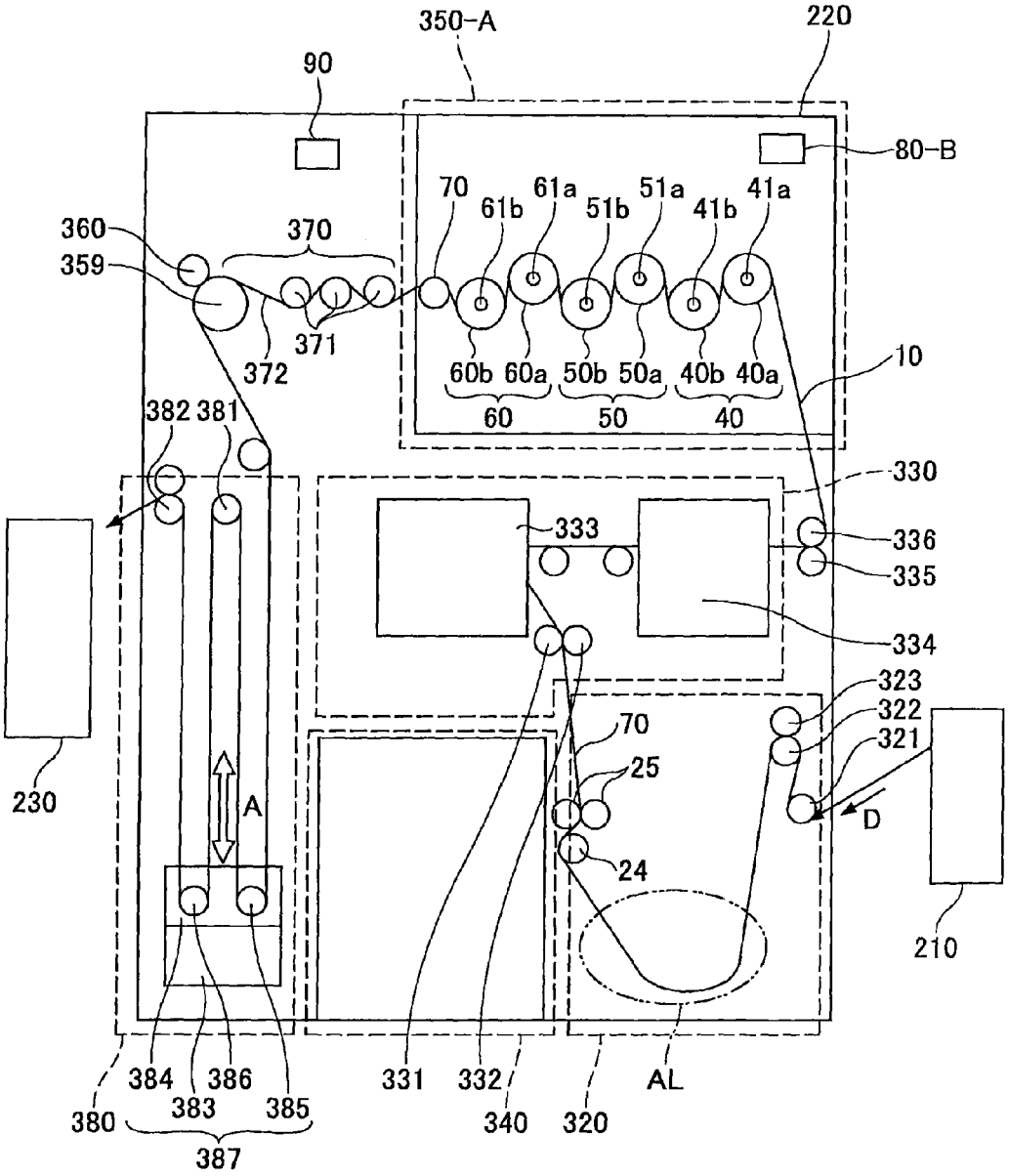
FIG. 11 is a schematic diagram illustrating a pretreatment liquid coating/drying apparatus used for the printing system of a variation of the second embodiment.

Furthermore, as a variation of the present embodiment, with reference to FIG. 11, additional rollers are provided downstream of the above-described heating rollers, and apply the heat control techniques with the following the mechanical cockling prevention techniques. Thus, the great effect can be achieved.

Figure 6:
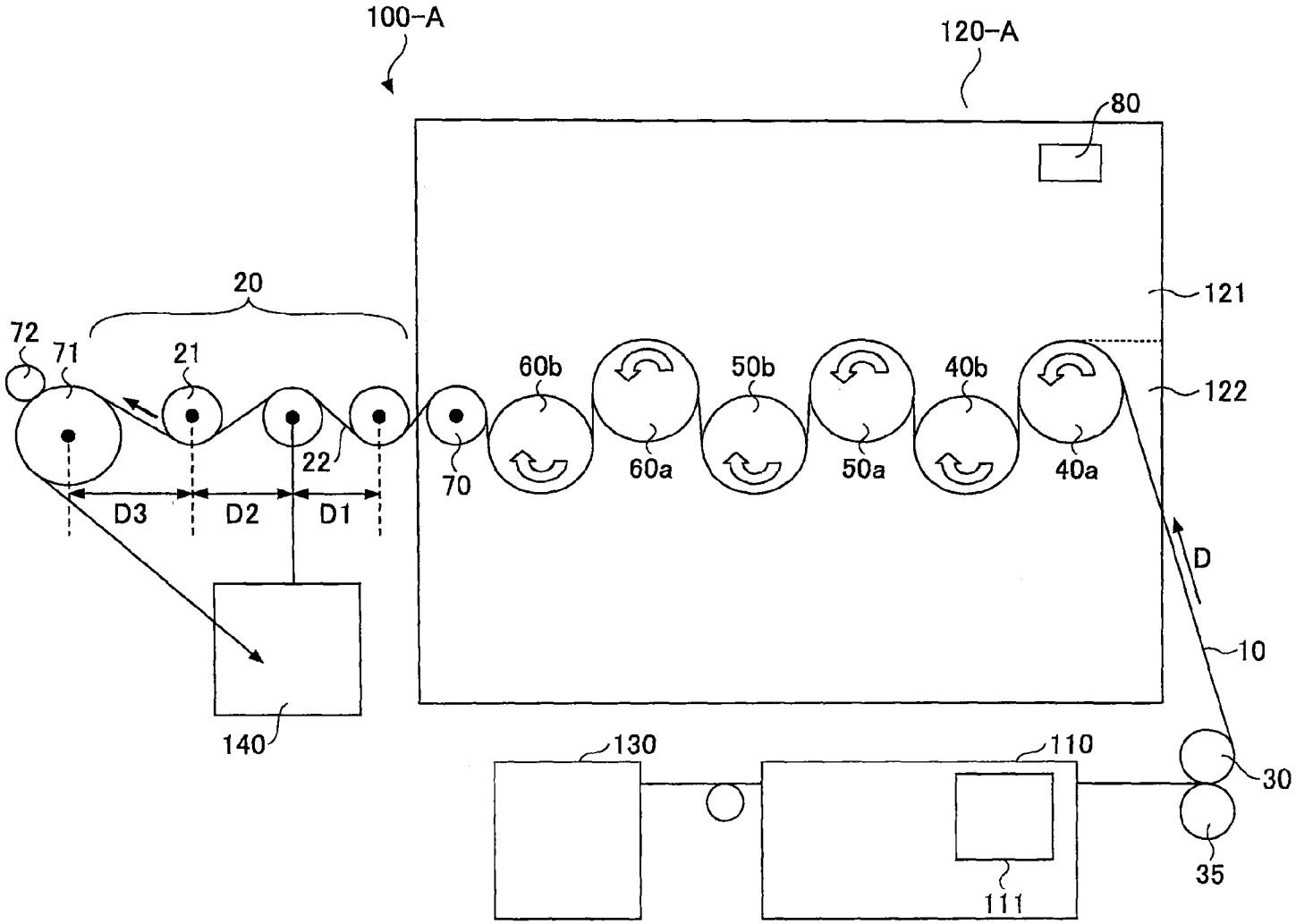
FIG. 6 is a schematic diagram illustrating a printing system including the recording medium heating apparatus according to a variation of the first embodiment.

In the variation shown in FIG. 11, similarly to FIG. 6, a cockling suppression mechanism (cockling suppression device) 370 is disposed on the downstream of the exit of the drying unit 350-A. In the variation of the present embodiment shown in FIG. 11, in the cockling suppression mechanism 370, hollow driven rollers 371, which are arranged in the conveyance direction, form a winding conveyance path 371 to bend in the conveyance direction multiple times. With this configuration, the cockling, such as wave-shaped deformation, occurring in the width direction of the recording medium 10 in the standby state can be suppressed. Also in the present embodiment, it is preferable that the cockling suppression mechanism 370 according to the present variation be provided in a case where high temperature of the most downstream heating roller is required even in starting because the required total heat amount is great, for example in a case where the recording medium is thick. Herein, the configuration of this variation of the second embodiment can achieve effects similar to those of the cockling suppression mechanism 50 described above.

In also in this variation, without using expensive manufacturer-specified paper for inkjet, during the pretreatment liquid coating operation, this control can eliminate the change (difference) in the humidity and temperature difference due to drying and absorbing moisture on the entrance side and the exit side of the heating/drying device 350-A, and the difference in the water content of the recording medium 10, to greatly lessen the cockling, such as wave-shaped deformation. Thus, in the foregoing process, without damaging the recording medium 10, the preferable image forming process can be performed in the inkjet printers 230 and 250 in the foregoing process, and winding up the recording medium 10 in the sheet winding apparatus 270 can be preferably performed.

Third Embodiment

Next, the control example according to the third embodiment is described below. The entire configuration (see FIG. 6) and the control block configuration (see FIG. 2) of the system are similar to the system according to the variation of the first embodiment; therefore, the description thereof is omitted.

In the present embodiment, what is different from the variation of first embodiment is as follows:

(i) The upper limit temperature (second setting temperature) is higher than the upper limit temperature of the first embodiment.

(ii) The temperatures of the heating rollers are changed from the upper limit temperature to the third setting temperature, when the controller detects that the temperature of not all the heating rollers but only the most downstream heating roller has been raised to the upper limit temperature.

(iii) A middle temperature is set at the middle of the process while the temperature is shifted from the upper limit temperature to the temperature during continuous drying.

In the process of printing, the controller 80 controls the respective heaters 41*a* through 61*b* such that the total amount of heat supplied to the recording medium 10 from the heating rollers 40*a* through 60*b* for use (total amount of heat corresponding to the increased setting temperature in the respective steps) exceeds the sufficient amount to evaporate the moisture and the solvent contained in the ink landing on the recording medium 10.

Herein, the controller 80 controls the setting temperatures, in accordance with the heat energy (supplying heat amount) to be supplied by using the electric signals (duty ratio). However, an actual temperature of the surface of the heating roller differs from the setting temperature because the heat near the surface of the heating roller is transferred to the passing recording medium. The temperature of the recording medium is lower than the surface temperature of the heating roller, especially, while the recording medium 10 is being conveyed, the heat of the heating roller is deprived by the passing recording medium.

During printing, when the print face (image forming face) of the recording medium is dried, since the heat is applied to the recording medium 10 by transferring the heat from the surface of the heating roller, it is necessary to evaporate the solvent component of the ink to decrease to a predetermined value.

However, while the recording medium 10 is being conveyed after the temperature has been raised to the first setting temperature so as to prevent the cockling, even when the setting temperature of the heater is increased from the first setting temperature to the second setting temperature, and the recording medium 10 whose temperature is lower than the surface temperature of the heating roller successively receives the temperature from the surface heating rollers. Therefore, the actual surface temperature is less likely to increase.

In particular, when the ambient temperature is low, the temperature of the recording medium passing through the outer area of the heating/drying device 120-A is low, and the temperature difference between the recording medium 10 and the surface temperatures of the heating rollers is small. Thus, the recording medium whose temperature is low deprives the heat from the surfaces of the heating rollers in succession, the heat transfer becomes great and the temperature in the body of the heating/drying device 120-A becomes low, and the heat release from the surface of the heating rollers is likely to occur. Accordingly, even when the heater is controlled so that the temperature is set to the setting temperature, the surface temperature of the heating roller is hardly increased.

When the temperatures of the heating rollers have not been raised to the setting temperature (temperatures having a gradient so as to homogeneously impart amounts of heat) during printings, in the setting where the outer temperature is low, the total heat amount is insufficient, and there is a risk of not being able to evaporate the solvent component of the ink. As described above, by setting the continuous drying temperatures having the temperature gradient, the damage to the recording medium becomes uniform, and the heat losses of the respective heating rollers 40*a* through 60*b* become uniform, the risk of the excessive temperature increase occurring is dispersed. The device service lives of the heaters 41*a* through 61*b* can be elongated (normalizes).

In the present embodiment, even when the ambient temperature is low, in order to accelerate raising the temperatures of the heating rollers 40*a* through 60*b* toward the setting temperatures whose amounts of heat imparted to the respective steps are made equal, the temperature is controlled such that the temperature transitions to the temperature higher than the upper limit setting temperature (second setting temperature). Herein, the second setting temperature is the temperature immediately after the starting period. The cockling caused by the shrinkage of the recording medium 10 during starting does not usually occur, when setting a higher temperature.

As the moment of detecting that the most downstream heating roller 60*b* has been raised to the second setting temperature, the temperatures of all the heating rollers 40*a* through 60*b* are decreased to the next temperatures. Herein, in the temperatures of the heaters whose amounts of heat imparted to the respective steps are made equal, the temperatures are gradually increased from upstream side to downstream side, the most downstream heating roller 60*b* is being raised to the highest setting temperature. Therefore, in order to smoothly shift the temperatures of the heating rollers toward the higher temperature, the temperature sensor 62*b* detects that the temperature of the most downstream heating roller 60*b* is raised to the second setting temperature.

Figure 12:
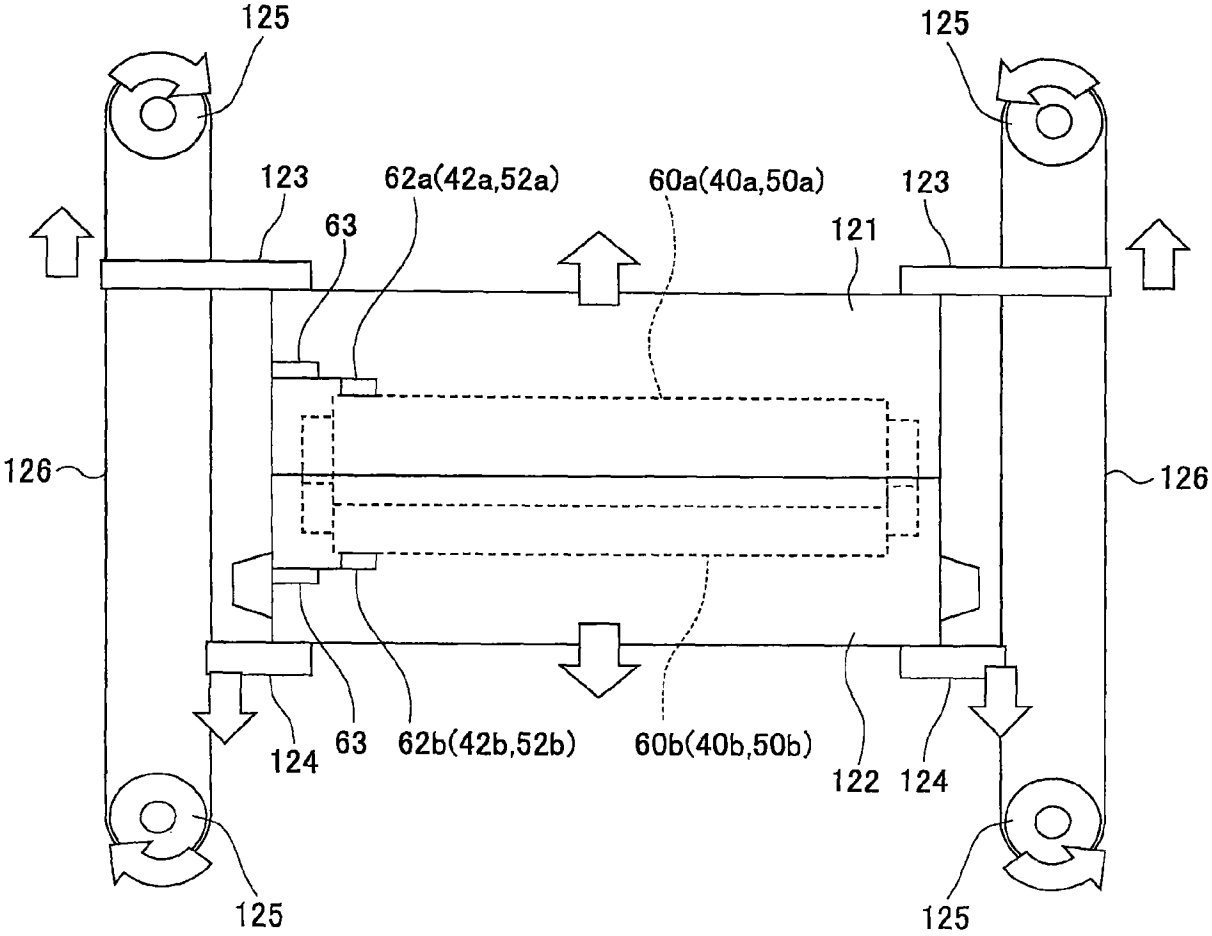
FIG. 12 is a diagram illustrating the recording medium while being conveyed in the recording medium heating unit, when viewed from downstream of the conveyance direction.

Herein, to detect the temperature of the heating roller 60*b*, for example, as shown in FIG. 12, the temperature sensor 62*b* is disposed on the end of the heating roller 60*b* and adjacent to the contact area of the heating roller 60*b* that comes in contact with the recording medium 10. With this configuration, the actual surface temperature of the heating rollers after the heat transfer to the recording medium is affected can be measured.

More specifically, in FIG. 12, the front-side heating unit 121 and the back-side heating unit 122 are fixed to two belts 126 wounding around pulleys 125 via arms 123 and 124. By rotating the pulleys 125, the heating/drying device 120-A is opened and closed. Herein, the temperature sensors (thermistors) 42*a* through 62*b* corresponding to the heating rollers 40*a* through 60*b* are fixed to the heating units 121, 122, using holders 63.

The heat controllers 81 through 86 of the controller 80 of the heating/drying device 120-A control the heating amount (temperatures) of the heating rollers 40*a* through 60*b* based on the detection results of the temperature sensors 42*a* through 62*b*.

In FIG. 12, the left side is set to be a reference side, for whichever width of the recording medium being passed. Since the recording medium 10 is conveyed along the reference side on the heating rollers, the recording medium always passes near the temperature sensors. Accordingly, the temperature sensors 42*a* through 62*b* can always measure the temperatures resulting from the heat transferred to the recording medium, as the surface temperatures of the heating rollers.

In addition, in the present embodiment, as described above, the upper limit temperature is high, the temperature difference between the continuous drying temperatures and the upper limit temperature is great, a third setting temperature is set between the upper limit temperature (second setting temperature) and the continuous drying temperatures (fourth setting temperatures) whose amounts of heat imparted to the respective steps of the heaters can be made equal. This control can avoid the great temperature change caused by shifting temperatures from the upper limit temperature to the continuous drying temperatures at once, and the temperatures can be gradually decreased.

In the present embodiment, the setting temperatures are constituted by four setting temperatures, the memory 88 stores multiple temperature tables as combinations of first setting temperatures (temperate in starting), a second setting temperature (upper limited temperature), third setting temperatures (middle temperature), and fourth setting temperatures (temperatures whose amounts of heat imparted to the respective steps are made equal; continuous drying temperature).

Figure 14:
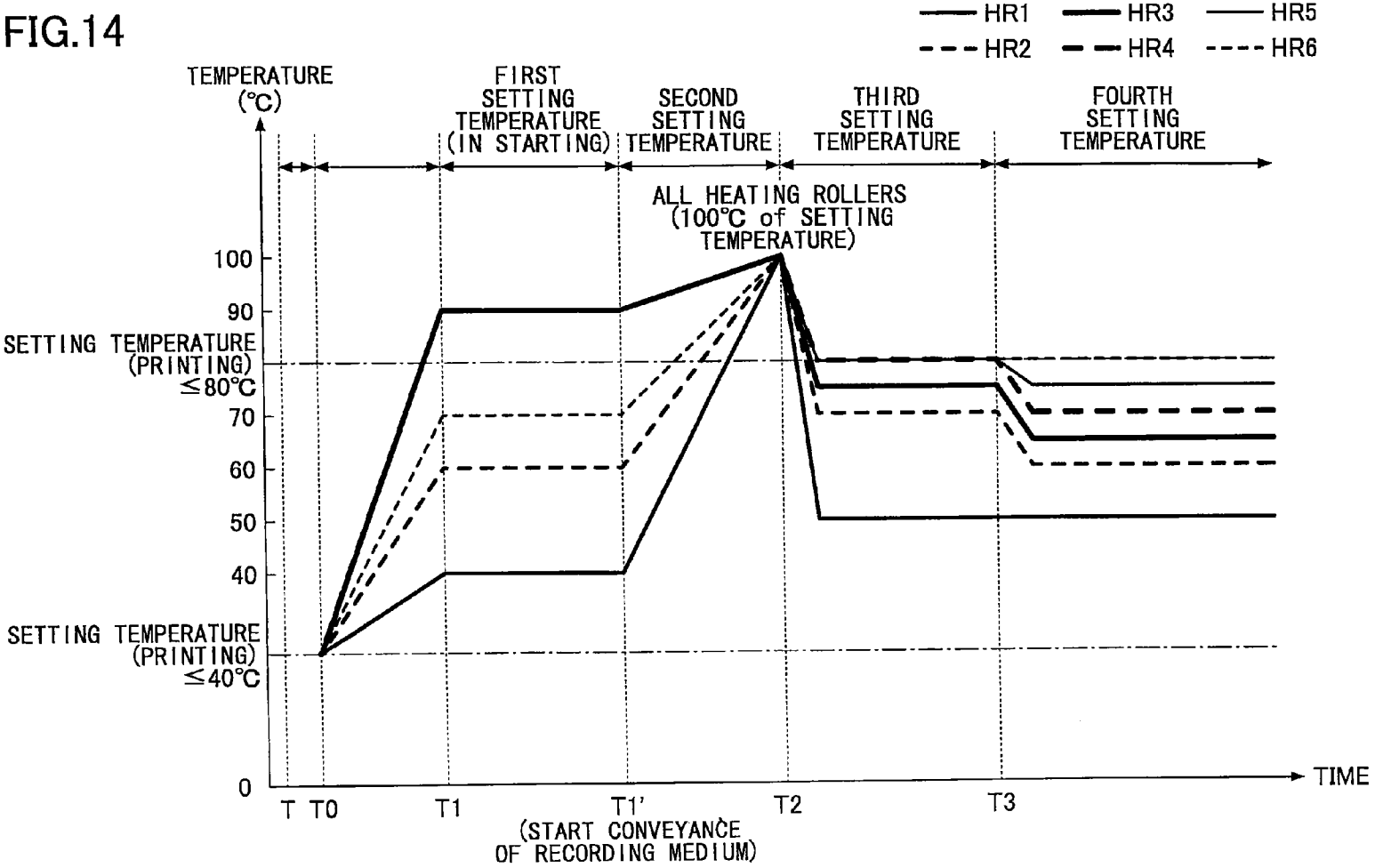
FIG. 14 is a graph illustrating settings temperatures of the heating rollers according to a third embodiment and a fourth embodiment of the present invention.

The schematic temperature control in the drying process in the system 100 including the heating/drying device 120-A according to the present embodiment is described below. FIG. 13 is a control flowchart illustrating the system (printing apparatus) 100-A of FIG. 7. FIG. 14 is a graph illustrating setting temperatures of the heating roller according to the present embodiment. FIG. 14 shows one example of the temperature transition of the setting temperatures in a case where coated paper A, pattern A, conveyance speed 50 mpm, and 80° C. of the maximum value of the setting temperature having the temperature gradient are used (which corresponds to the temperatures of TABLE 5 of the fourth embodiment, and the temperature transition of the setting temperature is similar to this graph).

In the flow relating to heating as shown in FIG. 13, when a print start is commanded from the control panel 91 and the PC/server 92 at step S300, the system 100-B starts the printing preparation process (timing T of FIG. 14, S301). As the printing preparation process, the printing controller (host apparatus) 90 recognizes the information of the printing type, the information of the recording medium, the information of the conveyance of the recording medium, acquired from the control panel 91 and the PC/server 92, so as to determine the setting temperatures.

At S303, the CPU 87 included in the controller 80 of the heating/drying device 120-A selects the suitable temperature tables, for example TABLE 4, that shows combinations of the suitable first, second, third, and fourth step setting temperatures, from the memory 88, in accordance with the information of the recording medium acquired at step S302.

TABLE 4

| | REQUIRED | SETTING TEMPERATURE | | | |
|---|---|---|---|---|---|
| | HEATING AMOUNT HAVING TEMPERATURE GRADIENT | FIRST SETTING TEMPERATURE IN STARTING | SECOND SETTING TEMPERATURE UPPER LIMIT TEMPERATURE | THIRD SETTING TEMPERATURE INTERMEDIATE TEMPERATURE | FOURTH SETTING TEMPERATURE HOMOGENEOUSLY IMPARTING AMOUNT OF HEAT |
| FIRST STEP BACK-SIDE HEATING ROLLER 40a | 50 | 40 | 90 | 50 | 50 |

TABLE 4-continued

| | REQUIRED | SETTING TEMPERATURE | | | |
|---|---|---|---|---|---|
| | HEATING AMOUNT HAVING TEMPERATURE GRADIENT | FIRST SETTING TEMPERATURE IN STARTING | SECOND SETTING TEMPERATURE UPPER LIMIT TEMPERATURE | THIRD SETTING TEMPERATURE INTERMEDIATE TEMPERATURE | FOURTH SETTING TEMPERATURE HOMOGENEOUSLY IMPARTING AMOUNT OF HEAT |
| FIRST STEP FRONT-SIDE HEATING ROLLER 40b | 55 | 60 | 90 | 60 | 55 |
| SECOND STEP BACK-SIDE HEATING ROLLER 50a | 60 | 80 | 90 | 65 | 60 |
| SECOND STEP FRONT-SIDE HEATING ROLLER 50b | 65 | 80 | 90 | 70 | 65 |
| THIRD STEP BACK-SIDE HEATING ROLLER 60a | 70 | 80 | 90 | 70 | 70 |
| THIRD STEP FRONT-SIDE HEATING ROLLER 60b | 70 | 60 | 90 | 70 | 70 |

Herein, as for the ink drying, the TABLE 4 shows the temperature transition of the setting temperature in a case where coated paper A, pattern A, conveyance speed 30 mpm, and 70° C. of the maximum value of the setting temperatures having the temperature gradient are used.

Based on a print start command from the printing controller 90, at S304, in the controller 80 of the heating/drying device 120-A, with reference to the temperature table, the heating controllers 81 through 86 heat the respective heating rollers 40*a* through 60*b* toward the first setting temperature (setting temperature in starting) (timing T0 in FIG. 14). As the first setting temperature in starting, the temperatures are set such that, the temperatures of the heating rollers 40*a*, 40*b*, 50*a*, 50*b*, 60*a*, and 60*b* are 40° C., 60° C., 60° C., 80° C., 80° C., and 60° C., respectively.

In the present embodiment, in setting the first setting temperatures in starting such that the temperature of the most downstream heating rollers 60*b* is 40° C., the temperature of the most upstream heating roller 40*a* is 50° C., heating roller the first setting temperatures of the heating rollers 40*a* through 60*b* can be set lower than the maximum value of the usual printing temperatures (continuous drying temperatures) so as to prevent the occurrence of cockling that is deformation of the recording medium. If the body of the heating/drying device 120-A is cool in starting, since the required heat amount in starting is great, temperatures of the heating rollers 50*a*, 50*b*, and 60*a* provided on the center area in the conveying path are set to 90° C. that is higher than usual (ambient temperature is not so cool).

By setting the first setting temperatures as described above, the temperature (60° C.) of the heating roller 60*b* provided closest to the exit side is set to be lower than the temperatures (80° C.) of the heating rollers 50*a*, 50*b*, and 60*a* provided on the center area away from the exit side.

Herein, in the present embodiment, the cockling suppression device 20 is provided downstream of the heating/drying device 120-A, even when the most downstream heating roller 60*b* starts being heated at 60° C. that is higher than that of the first embodiment, cockling of deformation and sheet shrinkage do not occur.

In addition, since the respective temperature differences among heating rollers 40*a* through 60*b* are set to 20° C., the change in the sheet shrinkage caused by the temperature difference among the heating roller can be alleviated, which effect to reduce cockling in the entire recording medium 10.

Subsequently, at S305, the controller 80 determines where the respective heating rollers 40*a* through 60*b* are heated to the first setting temperatures, based on the outputs of the respective temperature sensors 42*a* through 62*b*.

Then, at the timing t1 shown in FIG. 14, when the heating rollers 40*a* through 60*b* have raised to the respective first setting temperatures (Yes at S305), the controller 80 reports that the print preparation is finished to the printing controller 90, thereby starting the printing.

At step S306, the printing controller 90 controls the conveyance controller 94 such that the sheet feeding apparatus 130 and the respective conveyance rollers 113, 30, and 71 are driven to convey the recording medium 10, at the timing T1' shown in FIG. 14. At this time, the image forming units 111 and 112 of the image forming apparatus 110 start operation, and start ejecting the ink to the recording medium 10.

Along with the conveyance at S306, when the printing is started and the conveyance of the recording medium 10 is started, the temperatures of the heating rollers 40*a* through 60*b* are all increased toward the same second setting temperature. Herein, in the present embodiment, the second setting temperatures (90° C.) are 20° C. higher than the maximum value (70° C.) of the continuous drying setting temperatures having the temperature gradient. Since the second setting temperature is the temperature when the cockling does not occur due to the shrinkage of the recording medium 10 after the heating/drying unit 120 (–B) starts and the temperature that is the heating targets when the recording medium is conveyed, all the heating rollers 40*a* through 60*b* can be set higher.

Although depending on the ink amount, in the present embodiment, the second setting temperature (upper limit temperature) is 20° C. higher than that of the first embodiment, and all the heating rollers 40*a* through 60*b* are heated toward 90° C. Therefore, this setting can compensate for decrease in the heat amount in a case where the ambient temperature in the body of the heating/drying device 120-A is lower at the start of conveying the recording medium 10.

At S307, the controller 80 confirms with the temperature sensor 62*b* whether the most downstream heating roller 60*b* reaches the second setting temperature (90° C.) that is the upper limit setting temperature. It is to be noted that, even in a state where the actual temperatures of the heating rollers 40*a*, 50*a*, and 60*a* whose first setting temperatures in starting are set higher than that of the most downstream heating roller 60*b* may often become higher than (exceed) 90° C., since the heating rollers 50*a*, 50*b*, and 60*a* are provided on the center area and the excess temperature is the transient-state temperature, this state does not cause the occurrence of the cockling, which is not a problem.

When the most downstream heating roller 60*b* has been raised to the upper limit setting temperatures (YES at S307), the process proceeds to step S308. At a moment when reaching the temperatures of the heating rollers 40*a* through 60*b* reaches the second setting temperatures, the heating controllers 81 through 86 change the settings of the heaters 41*a* through 61*b* to the third setting temperatures (intermediate temperature).

It is to be noted that, in the first embodiment, in one example, the temperature may be kept for the predetermined time period from t2 to t2' of FIG. 5B. Alternatively, the temperature may be decreased to the third setting temperature immediately after the detection of reaching the second setting temperature. In the present embodiment, at the timing T2 shown in FIG. 14, when the temperature sensor 62*b* detects that the most downstream heating roller 60*b* has been raised to the second setting temperature, the heating controllers 81 through 86 change (decrease) the temperatures of the heating rollers 40*a* through 60*b* to the third setting temperatures. However, based on the ambient temperature and the types of the recording medium, the temperature may be kept at the second setting temperature if needed.

In the temperature setting in this flow, while the temperatures is being shifted (raised) (from the upper limit setting temperature, the temperature is shifted to the fourth setting temperature of the continuous drying temperature (homogeneously imparting amounts of heat) via one third setting temperature (intermediate temperature). However, the intermediate temperature (third setting temperature) may be set in steps.

Alternatively, after the temperature of the most downstream heating roller 60*b* has been raised to the second setting temperature (upper limit setting temperature), the temperature may be directly shifted to the continuous drying temperature without going through the intermediate temperature, similarly to the first embodiment.

Then, when a predetermined time period has elapsed after the most downstream heating roller 60*b* has been raised to the second setting temperature (upper limit temperature) (YES at S309), the setting temperature is switched from the third setting temperature to the fourth setting temperature (S310) (timing T3 shown in FIG. 14). Thus, the continuous printing operation (continuous drying) is performed.

Next, similarly to FIG. 3, the control system 500 determines whether the printing operation is finished (S311), whether the end of the image forming region (area) of the recording medium 10 reaches the exit of the heating/drying device 120-A (S312), whether the drying in the heating/drying device 120-A is completed (S313), and whether the entire conveyance is stopped and the control of the printing is completed (S314).

Accordingly, similarly to the first embodiment, the present embodiment keeps the temperature settings (having temperature gradient) whose amounts of heat imparted to the respective steps of the heaters can be made equal, the rapid temperature increase in the recording medium 10 can be avoided. Therefore, the system including the heating/drying device 120-A can minimize the heat load exerted on the recording medium 10. Thus, suffering the damage such as wrinkling and deformation of the recording medium 10 due to the heat load can be suppressed.

Further, in order to solve mild degree of the cockling occurring in the upstream side in the starting period, by setting the most upstream roller being the heating roller 40*a* to the low temperature, and by reducing the temperature difference between the heating/drying device 120-A and the outside, the partial shrinkage difference of the recording medium 10 occurring in the area close to the entrance of the heating/drying device 120-A can be prevented.

Furthermore, in the starting period, although the setting temperature of the most upstream heating rollers 60*b* is set higher than that of the first embodiment, by providing the cockling suppression mechanism 20, the partial shrinkage difference of the recording medium 10 can be prevented. In addition, the setting temperatures of the most upstream heating rollers 60*b* is set higher than that of the heating rollers 40*b*, 50*a*, and 50*b* positioned on the center area, the rapid temperature change of the recording medium 10 can be avoided.

Thus, in the starting period, this control can eliminate the change (difference) in the humidity and temperature difference due to drying and absorbing moisture on the entrance side and the exit side of the heating/drying device 120-A, and the difference in the water content of the recording medium 10, to greatly lessen the cockling, such as wave-shaped deformation. Thus, in the foregoing process, without damaging the recording medium 10, operation of winding up and folding the recording medium 10, can be appropriately performed.

Further, in the present embodiment, since the cockling suppression mechanism 20 is provided, and the temperatures of the heating rollers 40*a* through 60*b* are controlled such that the second setting temperature (upper limit temperature) immediately after the starting period is set higher than the maximum temperature during continuous drying, even when the ambient temperature is low, the heat amount required for continuous printing (drying) can be surely ensured.

Fourth Embodiment

The control example according to a fourth embodiments is described below. The entire configuration (see FIG. 11), the pretreatment liquid coating/drying apparatus 220 (see FIG. 8), and the control block configuration (see FIG. 9) are similar to system according to the variation of the second embodiment; therefore the description thereof is omitted.

In the present embodiment, what is different from the variation of second embodiment is as follows:

(i) The upper limit temperature (second setting temperature) is higher than the upper limit temperature of the second embodiment.

(ii) The temperatures are changed from the upper limit temperature to the third setting temperature, when the controller detects that the temperatures of not all the heating rollers but the most downstream heating roller 60*b* has been raised to the upper limit temperature.

(iii) A middle temperature is set at the middle of the process while the temperature is shifted from the upper limit temperature to the temperature during continuous drying.

What is different from the third embodiment is that, although the solvent (moisture) of ink is evaporated in the third embodiment, the solvent of the pretreatment liquid is evaporated in the present embodiment, the required heat amount differs, the setting temperatures of the temperature table differ. The way to transition the setting temperature and the setting way are almost identical to the third embodiment. Any of the required heat amounts is selected and used and the control flow process shown in FIG. 15 is determined such that the temperature is transitioned like that shown in FIG. 14.

Also in the present embodiment, the setting temperatures are changed for each time period so as to alleviate the damage to the recording medium caused by the first-step heating rollers 40*a*, 40*b* that initially contact the recording medium during continuous printing and so as to alleviate the shrinkage of the recording medium 10 caused by the third-step heating rollers 60*a*, 60*b* provided on the exit side during print starting.

Herein, the operation of the printing system 200 is described below, with reference to the flowchart shown in FIG. 15. The flow relating to the heating is mainly described.

FIG. 15 is a control flowchart illustrating the printing system 200. In FIG. 15, when a print start is commanded from the control panel 91 and the PC/server 92 at step S400, the printing system 200 starts the printing preparation process (timing T shown in FIG. 14, S401). Then, the printing controller (host apparatus) 90 recognizes the information of the printing type, the information of the recording medium, the information of the conveyance of the recording medium, acquired from the control panel 91 and the PC/server 92, so as to determine the setting temperatures (S402).

At S403, the CPU 87 included in the controller 80-B of the drying unit 350-A selects the suitable temperature tables, for example TABLE 5, that shows combinations of the suitable first, second, third and fourth step setting temperatures, from the memory 88, in accordance with the information of the recording medium acquired at step S402.

TABLE 5

| | REQUIRED | SETTING TEMPERATURE | | | |
|---|---|---|---|---|---|
| | HEATING AMOUNT HAVING TEMPERATURE GRADIENT | FIRST SETTING TEMPERATURE IN STARTING | SECOND SETTING TEMPERATURE UPPER LIMIT TEMPERATURE | THIRD SETTING TEMPERATURE INTERMEDIATE TEMPERATURE | FOURTH SETTING TEMPERATURE HOMOGENEOUSLY IMPARTING AMOUNT OF HEAT |
| FIRST STEP BACK-SIDE HEATING ROLLER 40a | 50 | 40 | 100 | 50 | 50 |
| FIRST STEP FRONT-SIDE HEATING ROLLER 40b | 60 | 60 | 100 | 70 | 60 |
| SECOND STEP BACK-SIDE HEATING ROLLER 50a | 65 | 90 | 100 | 75 | 65 |
| SECOND STEP FRONT-SIDE HEATING ROLLER 50b | 70 | 90 | 100 | 80 | 70 |
| THIRD STEP BACK-SIDE HEATING ROLLER 60a | 75 | 90 | 100 | 80 | 75 |
| THIRD STEP FRONT-SIDE HEATING ROLLER 60b | 80 | 70 | 100 | 80 | 80 |

Herein, as for one example of the pretreatment liquid drying, TABLE 5 shows the temperature transition of the setting temperature in a case where coated paper A, pattern A, 50 mpm of conveyance speed, and 80° C. of the maximum value of the setting temperatures (continuous drying temperatures) having the temperature gradient are used (Please see *3 of TABLE 1, temperature transition shown in FIG. 14). In the setting of TABLE 5, as a combination of the first setting temperatures, the temperature of the most downstream heating roller 60*b* is set to 70° C., the temperature of the heating roller 60*a* positioned on the second-most downstream side is set to 90° C., corresponding to 90° C. of the upper limit temperature (second setting temperature). Herein, even when the heating rollers are heated according to the settings shown in the temperature table of TABLE 5, the heat amount required for the above-described drying can be entirely ensured.

Based on the print start command from the printing controller 90, at step S404, the heating controllers 81 through 86 of the controller 80-A of the drying unit 350-A start heating the respective heating rollers 40*a* through 60*b* toward the defined first setting temperature in starting (timing T0 shown in FIG. 14). In the present embodiment, as shown in TABLE 5, the first setting temperatures are such that the temperatures of heating rollers 40*a*, 40*b*, 50*a*, 50*b*, 60*a*, and 60*b* are 40° C., 60° C., 90° C., 90° C., 90° C., and 70° C., respectively. Herein, in the present embodiment, since the cockling suppression mechanism 370 is provided on the downstream from the drying unit 350-A, even when the most downstream heating roller 60*b* starts heating at 70° C. that is higher than the second embodiment, the cockling does not occur.

Subsequently, at S405, the controller 80-B determines where the respective heating rollers 40*a* through 60*b* are heated to the first setting temperature, based on the outputs of the respective temperature sensors 42*a* through 62*b*, at the timing T1 shown in FIG. 14. Then, when the heating rollers 40*a* through 60*b* have been raised to the respective first setting temperatures (Yes at S405), the controller 80-B reports the coating preparation finishing to the printing controller 90, thereby starting the coating.

At step S406, before image formation, the printing controller 90 controls the conveyance controller 221 such that the sheet feed apparatus 210 and the respective feed rollers 322, 331, 335, and 359 are driven to convey the recording medium 10 (Convey ON). At this time, the coating controller 222 starts the pretreatment liquid coating units 33, 34 to apply the pretreatment liquid to the recording medium 10.

In the starting period during which coating is started (S406), the temperatures of the heating rollers 40*a* through 60*b* are all increased toward the same second setting temperature (timing t1' shown in FIG. 14, S407). Herein, in the present embodiment, depending on the amount of pretreatment liquid, the second setting temperature (upper limit temperature) is set 20° C. higher than the maximum value of the setting temperatures having the temperature gradient, and all the heating rollers are heated toward 100° C. Therefore, the decreased amount of the temperature in the body of the drying unit 350-A when the conveyance of the recording medium 10 is started can be compensated for.

Subsequently, the printing controller 90 of the control system 450 starts operating the first inkjet printer 230, and then the second inkjet printer 250 to start printing (S407).

At S408, the controller 80 confirms whether the heating roller 60*b* has been raised to the second setting temperature (100° C.) of the upper limit setting temperature, using the temperature sensor 62*b*. Herein, it is to be noted that, even in a case where the actual temperatures of the heating rollers 50*a*, 50*b*, and 60*a* whose first setting temperatures are set higher than the most upstream heating roller 60*b* may often become higher than (exceeds) 100° C., since the heating roller 50*a*, 50*b*, and 60*a* are provided in the center area of the drying unit 350-A and this excess temperatures are transient-state temperatures, the state does not cause the occurrence of cockling, which is not a problem.

When the most downstream heating roller 60*b* has been raised to the upper limit setting temperatures (YES at S408), the process proceeds to step S409. At a moment when the temperatures of the heating rollers 40*a* through 60*b* reach the second setting temperatures, the heating controllers 81 through 86 shift (decrease) the temperature to the third setting temperatures (intermediate temperature) (timing T2 shown in FIG. 14).

Herein, in the present embodiment, since the second setting temperature is set to be a much higher temperature, like that shown in the timing T2 shown in FIG. 14, when the most downstream heating roller 60*b* has been raised to the second setting temperature, the temperature is promptly shifted to the second setting temperature. However, based on the ambient temperature and the types of the recording medium, the temperature may be kept at the second setting temperature if needed.

Herein, this flow shows that, after the head unit 231 of the first inkjet printer 230 starts printing operation, the temperatures of the heating rollers 40*a* through 60*b* go to the third setting temperatures. However, in a case where the temperature of the most downstream heating roller 60*b* has been raised to the second setting temperature before the leading edge of the area of the recording medium 10 to which the pretreatment liquid is applied reaches the head unit 231, the temperatures of the heating rollers 40*a* through 60*b* are shifted to the third setting temperatures.

In the temperature setting in this flow, while the temperatures are being decreased (shifted) from the upper limit setting temperature, the temperature is shifted to the fourth setting temperature of the continuous drying temperature (homogeneously imparting amounts of heat) via one intermediate temperature (third temperature) that may be set in steps. Alternatively, after the temperature of the most downstream heating roller 60*b* has been raised to the second setting temperature (upper limit setting temperature), the temperature may be directly shifted to the continuous drying temperature without going through the intermediate temperature, similarly to the first embodiment.

Then, when a predetermined time period has elapsed after the most downstream heating roller 60*b* has been raised to the second setting temperature (upper limit temperature) (YES, S409), the setting temperature is switched from the third setting temperature to the fourth setting temperature (S410) (timing T3 shown in FIG. 14).

Thus, the continuous printing operation (continuous drying) is performed (S411).

Subsequently, the printing controller 90 of the control system 450 determines whether applying the pretreatment liquid is finished at S412.

Then, the controller 80-B in the control system 450 determines whether the end of the coated region of the recording medium 10 that is coated with the pretreatment liquid is discharged from the drying unit 350-A. Whether the end of the coated region of the recording medium 10 that is coated with the pretreatment liquid is discharged from the drying unit 350-A is determined based on the coating timing of the coating units 33 and 34, the conveyance timing of the respective conveyance members such as rollers 335, 359, 382, and the position of the movable frame 384. For example, a required time is calculated from the conveyance distance and the conveyance speed of the recording medium 10, and the calculated required time is compared with the time count result, so as to execute the determination.

After the end of the coated region of the recording medium 10 that is coated with the pretreatment liquid is discharged from the drying unit 350-A, the heating controllers 81 through 86 of the controller 80-B turn the respective heaters 41*a* through 61*b* OFF, and stop drying with the drying unit 350-A (S413).

Then, the printing controller 90 of the control system 450 causes the conveyance controller 221 of the pretreatment liquid coating/drying apparatus 220 and the conveyances controller 94 to stop conveying the recording medium with the conveyance members 355 and 70. Thus, the process is completed (S414).

With this control, similarly to the second embodiment, the present embodiment keeps temperature state where the temperatures whose amounts of heat imparted to the respective steps of the heating rollers are made equal during continuous printing, which can prevent breaking the temperature settings having temperature gradient where the temperature gradually increases from upstream side to downstream side during continuous printing. Accordingly, since rapid temperature increase in the recording medium 10 can be prevented, the printing system 200 including the drying unit (recording medium heating device) 350-A can minimize the heat load exerted on the recording medium 10.

Thus, suffering the damage such as wrinkle and deformation of the recording medium 10 due to the heat load can be suppressed.

Further, in order to solve mild degree of the cockling occurring in the upstream side in the starting period, by setting the most upstream roller being the heating roller 40*a* to a low temperature, and by reducing the temperature difference between the drying unit 350-A and the outside, the partial shrinkage difference of the recording medium 10 occurring in the area close to the entrance of the drying unit 350-A can be prevented.

Furthermore, although the setting temperatures in starting of the most upstream heating rollers 60*b* is set higher than that of the second embodiment, by providing the cockling suppression mechanism 20, the partial shrinkage difference of the recording medium 10 can be prevented. In addition, the setting temperatures of the most upstream heating rollers 60*b* is set higher than that of the heating rollers 40*b*, 50*a*, and 50*b* positioned on the center area, the rapid temperature change of the recording medium 10 can be avoided.

As described above, while the pretreatment liquid coating operation is performed, this control can eliminate the change (difference) in the humidity and temperature difference due to drying and absorbing moisture on the entrance side and the exit side of the heating/drying device 120, and the difference in the water content of the recording medium 10, to greatly lessen the cockling, such as wave-shaped deformation.

Thus, in the foregoing process, without damaging the recording medium 10 the preferable image forming process can be performed in the inkjet printers 230 and 250, and winding up the recording medium 10 in the sheet winding apparatus 270 can be preferably performed.

Further, in the present embodiment, since the cockling suppression mechanism 20 is provided, and the heating rollers are controlled such that the second setting temperature immediately after the starting period is set higher than the maximum value of the continuous drying setting temperatures, even when the ambient temperature is low, the heat amount required for continuous printing (drying) can be surely ensured.

The scope of the inventive subject matter should be determined with reference to the appended claims, along with the full scope of equivalents to which such claims are entitled. The recording medium heating apparatus, the treatment liquid coating/drying apparatus, and the image forming system according to the present invention are not limited to the above-described embodiments, and variations and modifications may be made without departing from the scope of the present invention.

The present application is based upon and claims the benefit of priority of Japanese Patent Applications No. 2014-111479, filed on May 29, 2014, and 2014-164908, filed on Aug. 13, 2014, the entire contents of which are incorporated herein by references.

What is claimed is:

1. A recording medium heating device to heat and dry a continuous recording medium, comprising:

multiple heating rollers including respective heaters, the multiple heating rollers being disposed on a conveying path of the recording medium, wherein the multiple heating rollers include a first-step heating roller positioned on an entrance side, a second-step heating roller positioned on a center area, and a third-step heating roller positioned on an exit side of the conveying path; and a controller to control the heating rollers, wherein, when the recording medium heating device is started, the controller heats the first-step heating roller, the second-step heating roller, and the third-step heating roller to a first set temperature of the respective rollers, wherein the first set temperature of the first-step heating roller and the third-step heating roller is lower than the first set temperature of the second-step heating roller, and after the first-step heating roller, the second-step heating roller, and the third-step heating roller are heated to the first set temperature of the respective rollers, the controller heats at least the first-step heating roller and the third-step heating roller to a second set temperature of the respective rollers, wherein the second set temperature of the first-step heating roller and the third-step heating roller is higher than or equal to a third set temperature that is a set temperature during continuous drying.

2. The recording medium heating device as claimed in claim 1, wherein a third set temperature of the second-step heating roller is higher than the third set temperature of the first-step heating roller, and the third set temperature of the third-step heating roller is higher than the third set temperature of the second-step heating roller.

3. The recording medium heating device as claimed in claim 1, wherein the respective second setting temperatures of the first-step heating roller, the second-step heating roller, and the third-step heating roller are an upper limit values of the set temperatures of the respective heating rollers.

4. The recording medium heating device as claimed in claim 1, after the first-step heating roller, the second-step heating roller, and the third-step heating roller reach the respective second setting temperatures, the controller shifts the first-step heating roller, the second-step heating roller, and the third-step heating roller from the respective second set temperatures to respective third setting temperatures.

5. The recording medium heating device as claimed in claim 1, after the third-step heating roller reaches the second set temperature, the controller shifts the first-step heating roller, the second-step heating roller, and the third-step heating roller from the respective second set temperatures to respective third set temperatures.

6. The recording medium heating device as claimed in claim 1, after the third-step heating roller reaches the second set temperature, the controller shifts the first-step heating roller, the second-step heating roller, and the third-step heating roller from the respective second set temperatures to respective intermediate temperatures, and then shifts the first-step heating roller, the second-step heating roller, and the third-step heating roller from the respective intermediate temperatures to the respective third set temperatures, wherein the respective intermediate temperatures are lower than the respective second set temperatures and higher than or equal to the respective third set temperatures.

7. A pretreatment liquid coating/drying apparatus, comprising:

a coating device to apply a pretreatment liquid onto a continuous recording medium; and a recording medium heating device to heat and dry the recording medium, the recording medium heating device including:

multiple heating rollers including respective heaters, the multiple heating rollers being disposed on a conveying path of the recording medium, wherein the multiple heating rollers include a first-step heating roller positioned on an entrance side, a second-step heating roller positioned on a center area, and a third-step heating roller positioned on an exit side of the conveying path; and a controller to control the heating rollers, wherein, when the recording medium heating device is started, the controller heats the first-step heating roller, the second-step heating roller, and the third-step heating roller to a first set temperature of the respective rollers, wherein the first set temperature of the first-step heating roller and the third-step heating roller is lower than the first set temperature of the second-step heating roller, and after the first-step heating roller, the second-step heating roller, and the third-step heating roller are heated to the first set temperature of the respective rollers, the controller heats at least the first-step heating roller and the third-step heating roller to a second set temperature of the respective rollers, wherein the second set temperature of the first-step heating roller and the third-step heating roller is higher than or equal to a third set temperature that is a set temperature during continuous drying.

8. The pretreatment liquid coating/drying apparatus as claimed in claim 7, further comprising:

a cockling suppression mechanism provided near the recording medium heating device and positioned outside of the exit of the conveyance path in the recording medium heating device, to curl the recording medium multiple times in a direction in which the recording medium is conveyed.

9. A printing system, comprising:

the pretreatment liquid coating/drying apparatus as claimed in 7; and a printing apparatus to eject ink onto the recording medium on which the pretreatment liquid is applied and dried by the pretreatment liquid coating/drying apparatus.

10. The recording medium heating device of claim 1, wherein the respective second setting temperatures of the first-step heating roller, the second-step heating roller, and the third-step heating roller are a same value.

11. The recording medium heating device of claim 1, wherein a difference in temperature between the second setting temperature of the second-step heating roller and the second setting temperature of the first-step heating roller is less than a difference in temperature between the first setting temperature of the second-step heating roller and the first setting temperature of the first-step heating roller.

12. The recording medium heating device of claim 1, further comprising a sensor configured to detect surface temperatures of the first-step heating roller, the second-step heating roller, and the third-step heating roller, wherein the controller changes the set temperatures of the first-step heating roller, the second-step heating roller, and the third-step heating roller, based on the surface temperatures detected by the sensor.

13. A printing apparatus, comprising:

a conveyer configured to convey the recording medium;

a recording device configured to eject ink onto the recording medium; and the recording medium heating device as claimed in claim 1 configured to dry the recording medium.

* * * * *